US011791594B2

(12) United States Patent
Maesoba et al.

(10) Patent No.: US 11,791,594 B2
(45) Date of Patent: Oct. 17, 2023

(54) ELECTRIC WIRE WITH TERMINAL, TERMINAL MODULE, AND CONNECTOR

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Hiroyoshi Maesoba, Yokkaichi (JP); Toshifumi Ichio, Yokkaichi (JP); Kazuhiro Yoshida, Yokkaichi (JP); Masanao Yamashita, Osaka (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 200 days.

(21) Appl. No.: 17/417,627

(22) PCT Filed: Dec. 23, 2019

(86) PCT No.: PCT/JP2019/050329
§ 371 (c)(1),
(2) Date: Feb. 28, 2022

(87) PCT Pub. No.: WO2020/137963
PCT Pub. Date: Jul. 2, 2020

(65) Prior Publication Data

US 2022/0200211 A1 Jun. 23, 2022

(30) Foreign Application Priority Data

Dec. 28, 2018 (JP) ..... 2018-247606

(51) Int. Cl.
*H01R 13/64* (2006.01)
*H01R 13/6592* (2011.01)
(Continued)

(52) U.S. Cl.
CPC ..... *H01R 13/6592* (2013.01); *H01B 7/28* (2013.01); *H01R 4/184* (2013.01); *H01R 13/6473* (2013.01)

(58) Field of Classification Search
CPC ..... H01R 13/6592; H01R 4/184; H01R 13/6473; H01R 13/65912; H01B 7/28
See application file for complete search history.

(56) References Cited

U.S. PATENT DOCUMENTS 4,611,878 A * 9/1986 Hall ..... H01R 13/6593 439/353
8,926,368 B2 1/2015 Il
(Continued)

FOREIGN PATENT DOCUMENTS

CN 107946823 A 4/2018
JP 2013-229255 A 11/2013
(Continued)

*Primary Examiner* — Truc T Nguyen
(74) *Attorney, Agent, or Firm* — Oliff PLC

(57) ABSTRACT

An electric wire with a terminal described herein includes a shielded electric wire 11 and an inner conductive member 20. The shielded electric wire 11 includes a covered wire 12 including a core wire 13 through which a signal for communication is transmitted and an insulation cover 14 that has insulation property and covers the core wire 13, a shielding portion 15 having electric conductive property and covering an outer periphery of the covered wire 12, and a sheath 16 covering an outer periphery of the shielding portion 15. The inner conductive member 20 is connected to the covered wire 12. The covered wire 12 has an end portion close to the inner conductive member 20 and the end portion is an uncovered portion 17 that is not covered with the sheath 16
(Continued)

and the shielding portion 15. The uncovered portion 17 is covered with an impedance adjustment member 80 that has electric conductive property.

16 Claims, 23 Drawing Sheets

(51) Int. Cl.

| | |
|---|---|
| ***H01B 7/28*** | (2006.01) |
| ***H01R 4/18*** | (2006.01) |
| ***H01R 13/6473*** | (2011.01) |

(56) References Cited

U.S. PATENT DOCUMENTS

| | | | | |
|---|---|---|---|---|
| 10,103,505 | B1 * | 10/2018 | Izaki | H01R 31/06 |
| 10,297,932 | B2 | 5/2019 | Maesoba et al. | |
| 10,653,000 | B2 * | 5/2020 | Lo | H05K 1/0233 |
| 10,763,600 | B2 | 9/2020 | Maesoba et al. | |
| 10,840,650 | B2 * | 11/2020 | Winkler | H01R 29/00 |
| 11,056,843 | B2 * | 7/2021 | Winkler | H01R 12/722 |
| 2009/0058759 | A1 * | 3/2009 | Morikawa | H01P 5/085 343/906 |
| 2016/0093984 | A1 * | 3/2016 | Iwamoto | H01R 13/65915 439/607.55 |
| 2018/0102597 | A1 | 4/2018 | Maesoba et al. | |
| 2018/0198266 | A1 * | 7/2018 | Inoue | H01R 13/115 |
| 2019/0252806 | A1 | 8/2019 | Maesoba et al. | |
| 2019/0312388 | A1 | 10/2019 | Maesoba et al. | |
| 2023/0033981 | A1 * | 2/2023 | Matsuda | H01R 13/502 |
| 2023/0072308 | A1 * | 3/2023 | Mabuchi | H02G 1/12 |

FOREIGN PATENT DOCUMENTS

| | | | | |
|---|---|---|---|---|
| JP | WO2014126224 | * | 8/2014 | H01R 24/52 |
| JP | 2017-126499 A | | 7/2017 | |
| JP | 2018-063795 A | | 4/2018 | |

* cited by examiner

ELECTRIC WIRE WITH TERMINAL, TERMINAL MODULE, AND CONNECTOR

TECHNICAL FIELD

The technology disclosed herein relates to an electric wire with a terminal, a terminal module, and a connector.

BACKGROUND ART

For example, a shielded connector described in Japanese Unexamined Patent Application Publication No. 2013-229255 (Patent Document 1 described below) has been known as a shielded connector that is connected to an end of a shielded electric wire. The shielded electric wire includes shielded wires obtained by covering inner conductive members with insulating protection covers and outer peripheries of the shielded wires are further covered with a shielding foil and a sheath. Male terminals are electrically connected to the ends of the inner conductive members of the shielded wires, respectively.

PRIOR ART DOCUMENT

Patent Document

[Patent Document 1] Japanese Unexamined Patent Application Publication No. 2013-229255

SUMMARY OF THE INVENTION

Problem to be Solved by the Invention

The shielding foil and the sheath need to be stripped at the end of the shielded electric wire to electrically connect the terminals to the respective ends of the shielded wires in such a type of connector. This creates a portion that is uncovered with the shielding foil at the end of the shielded electric wire and the impedance at the uncovered portion changes from the impedance at the portion covered with the shielding foil. At the impedance changing point, signals may be reflected and communication quality may be lowered.

The specification discloses the technology for suppressing lowering of communication quality.

Means for Solving the Problem

A technology described herein is an electric wire including a shielded electric wire and a terminal. The shielded electric wire includes a covered wire including a core wire through which a signal for communication is transmitted and an insulation cover that has insulation property and covers the core wire, a shielding portion having electric conductive property and covering an outer periphery of the covered wire, and a sheath covering an outer periphery of the shielding portion. The terminal is connected to the covered wire. The covered wire has an end portion close to the terminal and the end portion is an uncovered portion that is not covered with the sheath and the shielding portion. The uncovered portion is covered with an impedance adjustment member that has electric conductive property.

According to the electric wire having such a configuration, the uncovered portion of the covered wire is covered with the impedance adjustment member having an electric conductive property. The uncovered portion of the covered wire projecting and exposed from the shielding portion is covered with the electrically conductive member and the electrically conductive member extends to cover the uncovered portion of the covered wire projecting from the shielding portion just before the end portion to be connected to the terminal. According to such a configuration, the impedance is less likely to change between the covered wire covered with the shielding portion and the uncovered portion. This suppresses lowering of the communication quality of the covered wire.

The electric wire disclosed herein may have following configurations.

The covered wire of the shielded electric wire may include covered wires each of which has the uncovered portion and the impedance adjustment member may include adjustment body portions that have a tubular shape and mounted on and along an outer peripheral surface of the uncovered portion of each of the covered wires.

According to such a configuration, since the uncovered portions of the covered wires projecting from the shielding portion are covered with the adjustment body portions, respectively and independently from each other, each of the adjustment body portions can suppress change in the impedance of the corresponding one of the uncovered portions of the covered wires independently. Therefore, the impedance is further less likely to change at the uncovered portion compared to a configuration that the uncovered portions of the covered wires are collectively covered with an impedance adjustment member.

The adjustment body portions may include slits, respectively, that extend in a circumferential direction.

According to such a configuration, the area of the adjustment body portion that covers the uncovered portion can be changed easily by changing the size of the slit. Therefore, the impedance in the uncovered portion can be easily adjusted and the accuracy of adjusting the impedance in the uncovered portion can be improved. This further suppresses occurrence of the reflection of signals between the covered wire covered with the shielding portion in the shielded electric wire and the uncovered portion and lowering of the communication quality is further suppressed.

The impedance adjustment member may further include a connection portion that connects the adjustment body portions.

Since the adjustment body portions are connected by the connection portion, the number of components included in the impedance adjustment member is reduced compared to a configuration including adjustment body portions each of which is prepared separately for each of the uncovered portions.

The technology described herein is a terminal module that includes the electric wire including terminals and a terminal housing member in which the terminals are arranged. The connection portion connects the adjustment body portions such that a distance between the covered wires is substantially equal to a distance between the terminals in the terminal housing member. The configuration that the distances are substantially equal includes a configuration that the distance between the covered wires is same as the distance between the terminals and also a configuration that the distance between the covered wires is not just same as the distance between the terminals and a configuration that the distances are slightly different.

According to the terminal module having such a configuration, the connecting portion of the impedance adjustment member can adjust the distance between the covered wires to match the distance between the terminals in the terminal housing member. This improves the operability of mounting the terminals in the terminal housing member compared to a configuration in which each of the terminals is positioned and mounted in each of the mounting positions in the terminal housing member.

The terminal housing member may include an adjustment member housing portion in which the impedance adjustment member is arranged. The terminal housing member may include a position error detection portion between a portion in which the terminals are arranged and the adjustment member housing portion and the position error detection portion is contacted with the impedance adjustment member when the impedance adjustment member is not mounted in a correct position with respect to the uncovered portion.

For example, if the impedance adjustment member is mounted in an incorrect position, which is different from the correct position, with respect to the uncovered portions of the covered wires, the impedance may not be adjusted effectively in the uncovered portions and the communication quality may be lowered. If the impedance adjustment member is mounted closer to the terminals, the terminals may be contacted with the impedance adjustment member and a short circuit may occur between the terminals.

However, according to such a configuration, if the impedance adjustment member is mounted in an incorrect position and closer to the front side with respect to the uncovered portions, the following problems may be caused. The adjustment body portions of the impedance adjustment member may be contacted with the position error detection portion when the impedance adjustment member is mounted in the adjustment housing member. Therefore, the impedance adjustment member that is in the incorrect position cannot be mounted in the adjustment housing member. Accordingly, the communication quality is less likely to be lowered due to the incorrect positioning of the impedance adjustment member and a short circuit may not occur between the terminals. Further, the impedance adjustment member may not be moved frontward with respect to the uncovered portions due to vibration.

The position error detection portion may be a separation wall that separates the terminals from each other in the terminal housing member.

According to such a configuration, the incorrect positioning of the impedance adjustment member can be detected by the separation wall that defines each of the cavities in the terminal housing member. Therefore, an incorrect position detection portion need not be additionally and separately provided in the terminal housing member and a shape of the terminal housing member is less likely to become complicated.

The technology described herein includes the terminal module, an outer conductive member covering an outer periphery of the terminal module, and a housing in which the terminal module covered with the outer conductive member is arranged.

Effects of Invention

According to the technology described herein, communication quality is less likely to be lowered.

MODES FOR CARRYING OUT THE INVENTION

Embodiment

Figure 1:
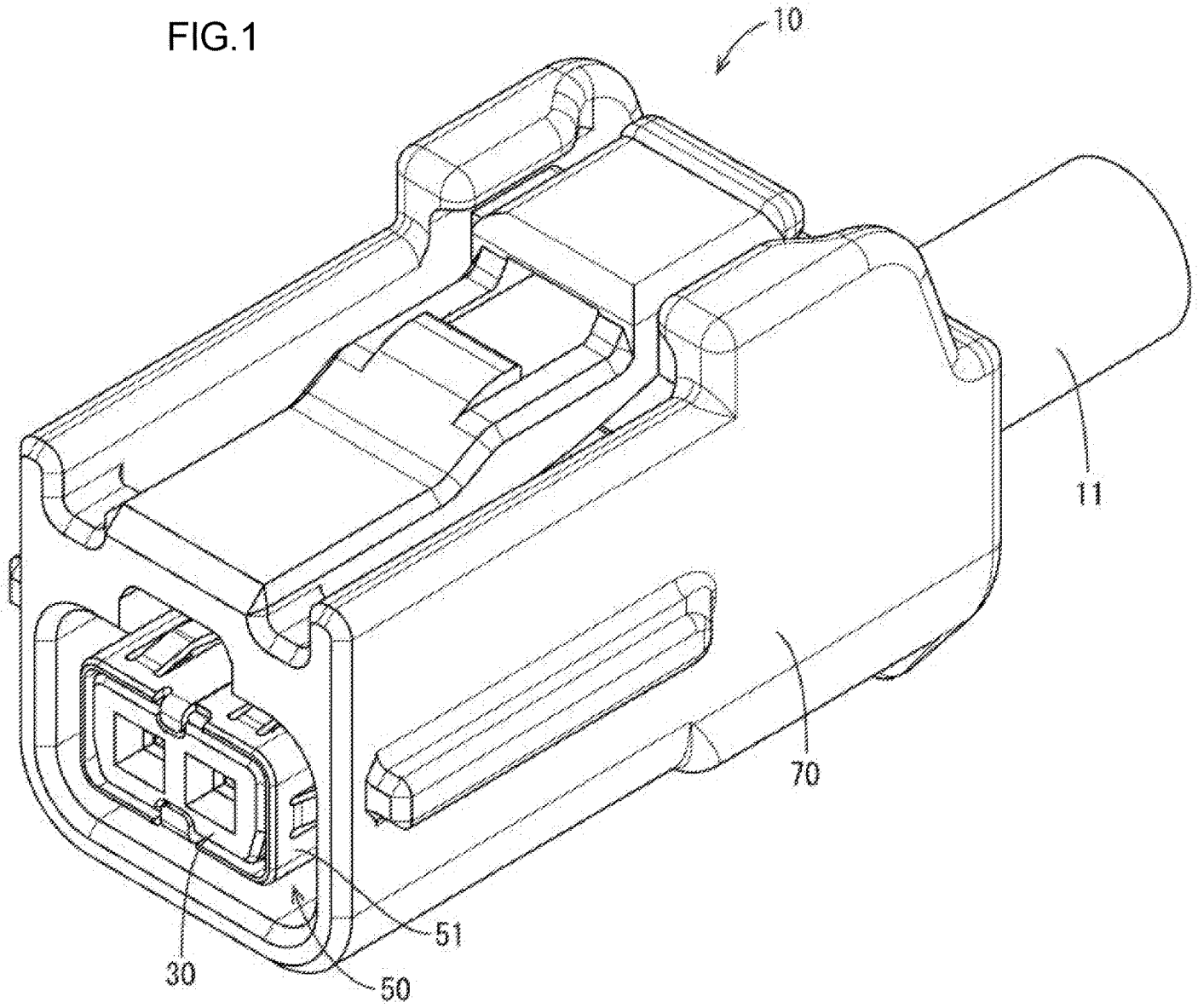
FIG. 1 is a perspective view of a connector according to one embodiment.
Figure 2:
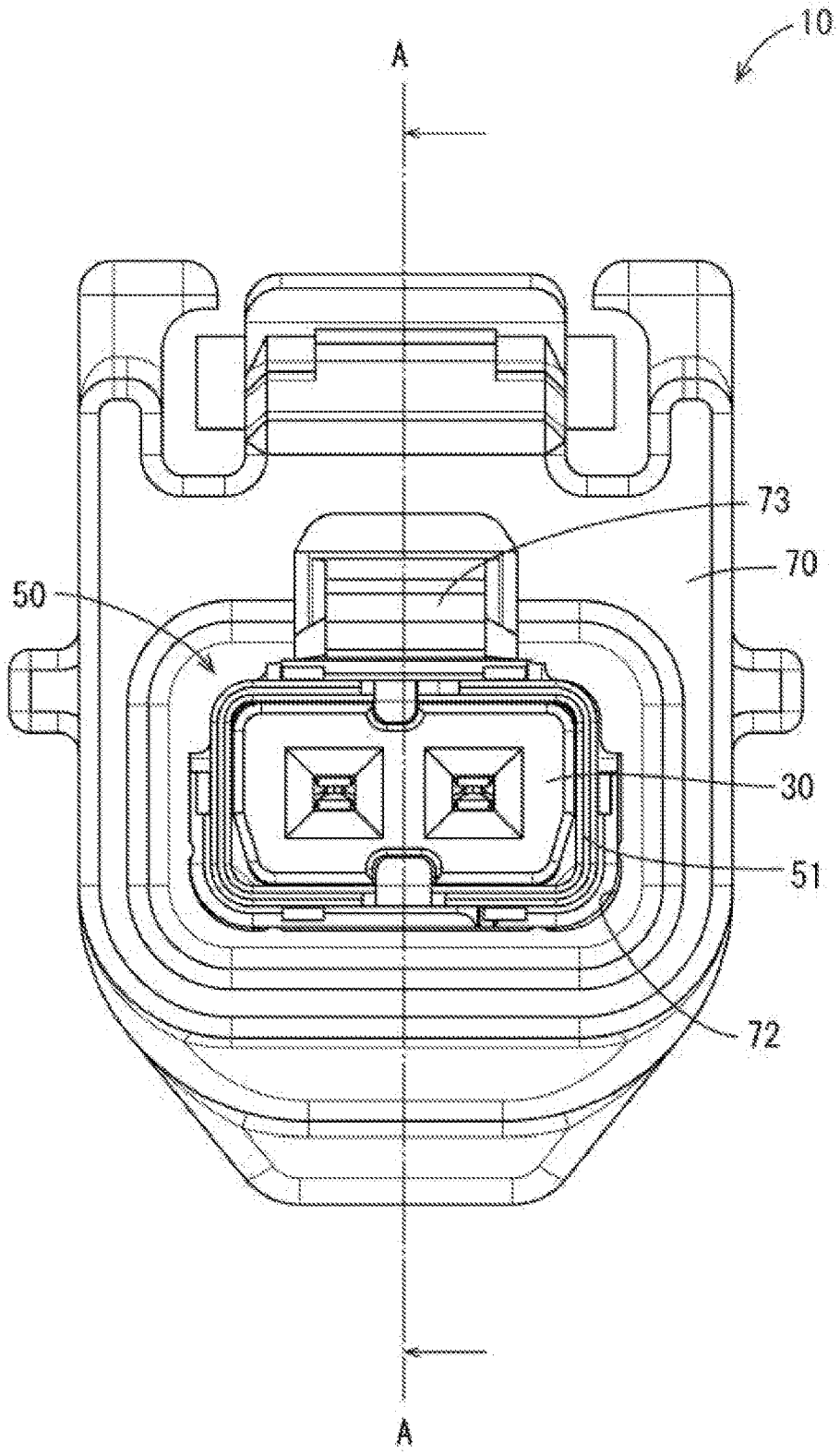
FIG. 2 is a front view of the connector.

One embodiment according to the technology described herein will be described with reference to FIGS. 1 to 23. In the present embodiment, a connector 10 that is for communication and mounted in vehicles such as an electric automobile or a hybrid automobile will be described as an example. For example, the connector 10 is arranged in a wired communication network between electric devices installed in a vehicle (such as a car navigation system, an ETC system, and a monitor) and an external device (such as a camera).

As illustrated in FIGS. 1 to 4, the connector 10 includes a shielded electric wire 11, inner conductive members 20 (one example of a terminal) that are connected to a leading end of the shielded electric wire 11, a terminal housing member 30 in which the inner conductive members 20 are arranged, an outer conductive member 50 that is connected to the shielded electric wire 11 while covering an outer periphery of the terminal housing member 30, and a housing 70 in which the outer conductive member 50 is arranged.

The shielded electric wire 11 includes covered wires 12, a shielding portion 15, and a sheath 16. The shielding portion 15 is formed of braided wires and collectively covers outer peripheries of the covered wires 12. The sheath 16 is formed of an insulating cover and covers an outer periphery of the shielding portion 15. In the shielded electric wire 11 of the present embodiment, the two covered wires 12 are collectively covered with the shielding portion 15.

Each of the covered wires 12 includes an electrically conductive core wire 13 and an insulation cover 14 with which the core wire 13 is covered. The two covered wires 12 that are covered with the shielding portion 15 are twisted. The sheath 16 is stripped at the leading end portion of the shielded electric wire 11 and the two covered wires 12 are untwisted and the shielding portion 15 are uncovered.

The insulation cover 14 is stripped at the leading end portion of each covered wire 12 that projects from the end of the sheath 16 and the core wires 13 are uncovered. The uncovered core wires 13 are electrically connected to the respective inner conductive members 20.

The shielding portion 15 is formed of electrically conductive metal thin wires that are braided into a tubular shape. The portion of the shielding portion 15 projecting from the end of the sheath 16 is folded back on the outer periphery of the end portion of the sheath 16 and is configured as a folded portion 15A. The folded portion 15A covers the outer periphery of the end portion of the sheath 16.

Each of the inner conductive members 20 is formed by pressing a metal plate having an electric conductive property. Each of the inner conductive members 20 is a so-called female terminal and includes a connection tubular portion 22 and a wire connection portion 24. The connection tubular portion 22 has a square tubular shape and a male terminal pin, which is not illustrated, is to be inserted in and connected to the connection tubular portion 22. The wire connection portion 24 is continuous rearward from the connection tubular portion 22 and crimped on and connected to the core wire 13.

Figure 20:
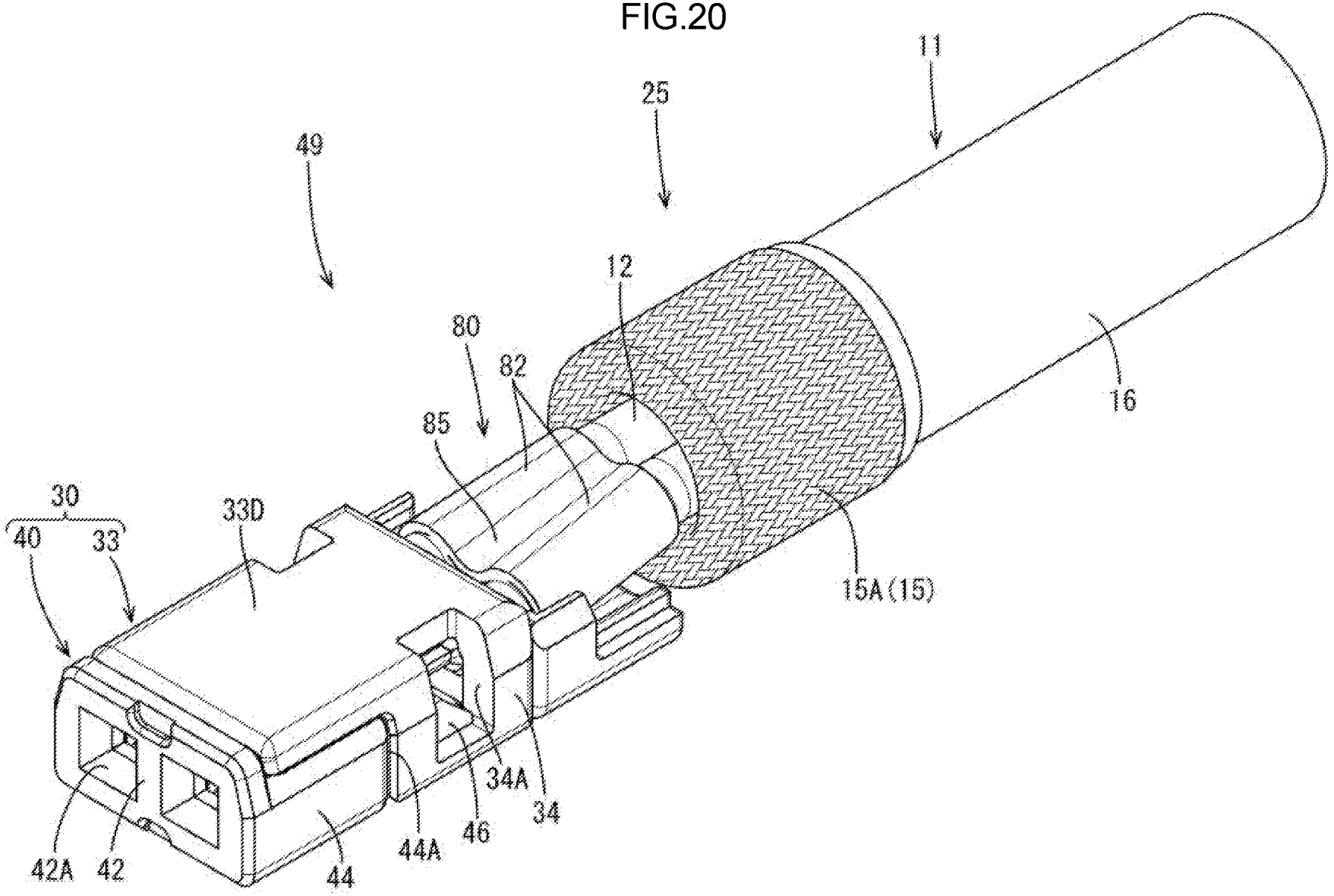
FIG. 20 is a perspective view illustrating a terminal module that is disposed upside down.

The terminal housing member 30 is made of synthetic resin and has a rectangular square shape elongating in a front-rear direction as illustrated in FIG. 20.

Figure 3:
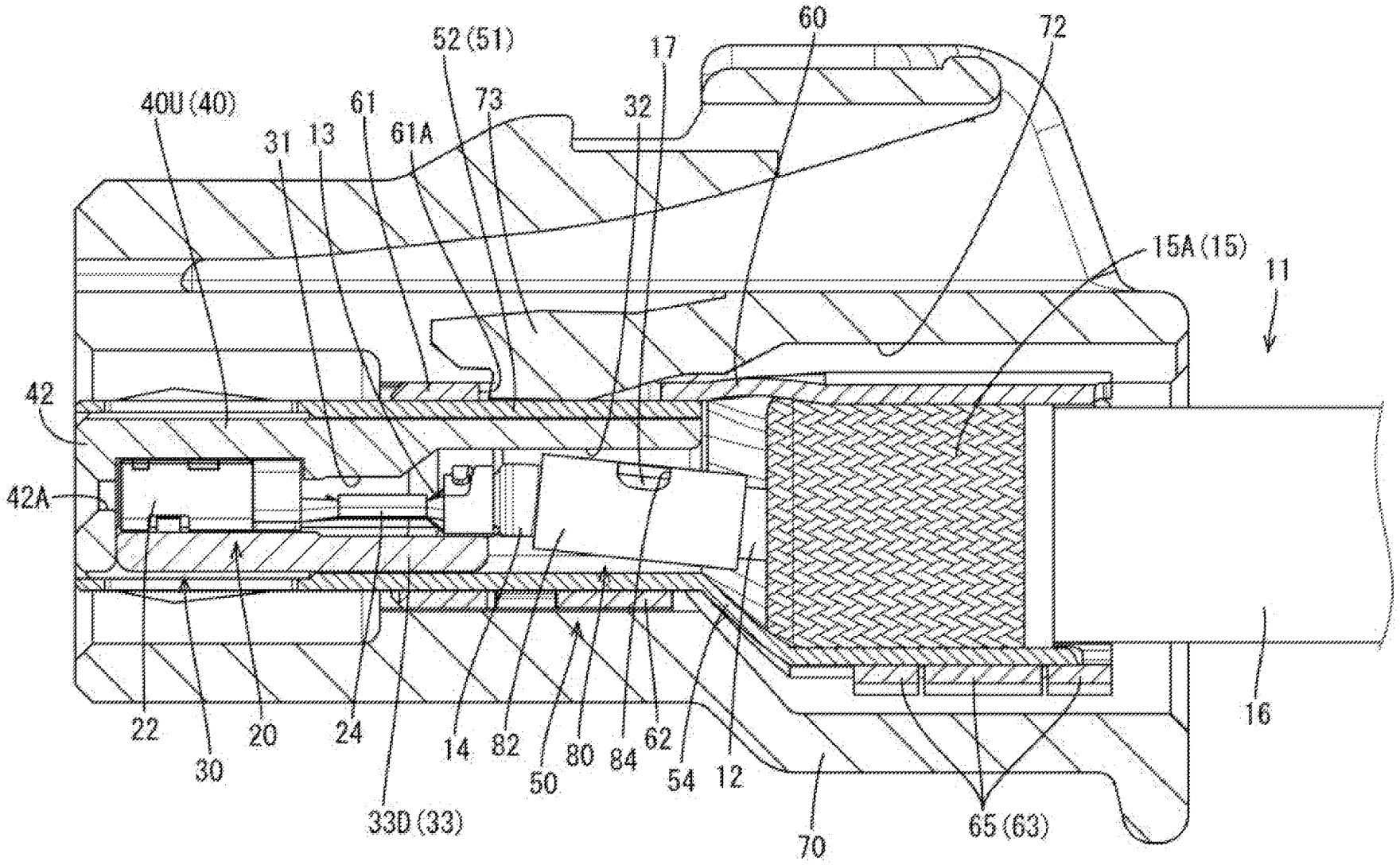
FIG. 3 is a cross-sectional view taken along A-A line in FIG. 2.
Figure 22:
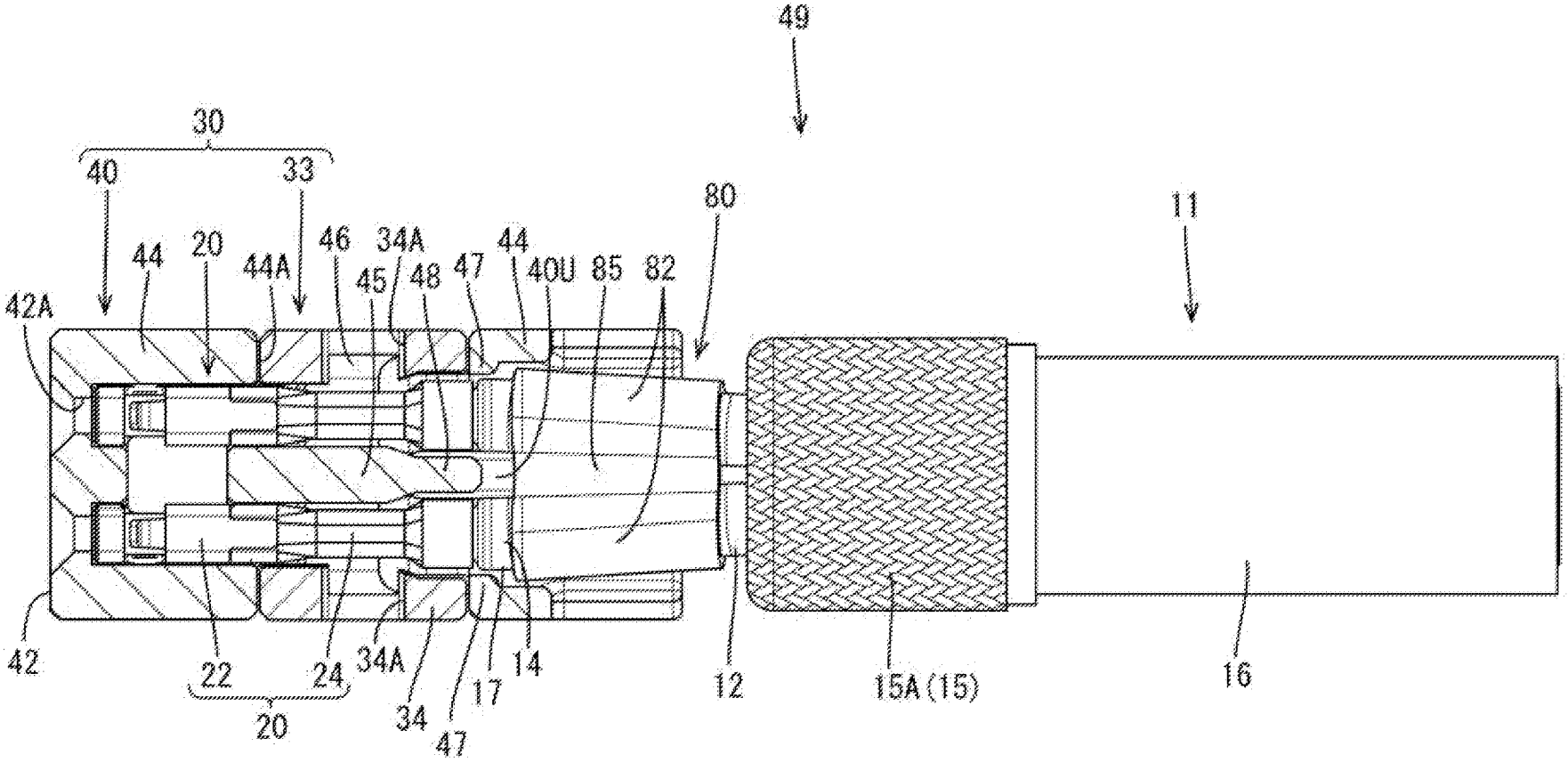
FIG. 22 is a cross-sectional view taken along D-D line in FIG. 21.

As illustrated in FIGS. 3 and 22, the terminal housing member 30 includes cavities 31 in a front section thereof with respect to a middle section in the front-rear direction. The cavities 31 are arranged in a right-left direction and each of the cavities 31 extends in the front-rear direction. Each of the cavities 31 can receive the inner conductive member 20 that is connected to the covered wire 12.

The terminal housing member 30 includes a large housing portion 32 at a rear section thereof. The covered wires 12 that extend rearward from the respective cavities 31 are collectively arranged in the large housing portion 32.

Figure 19:
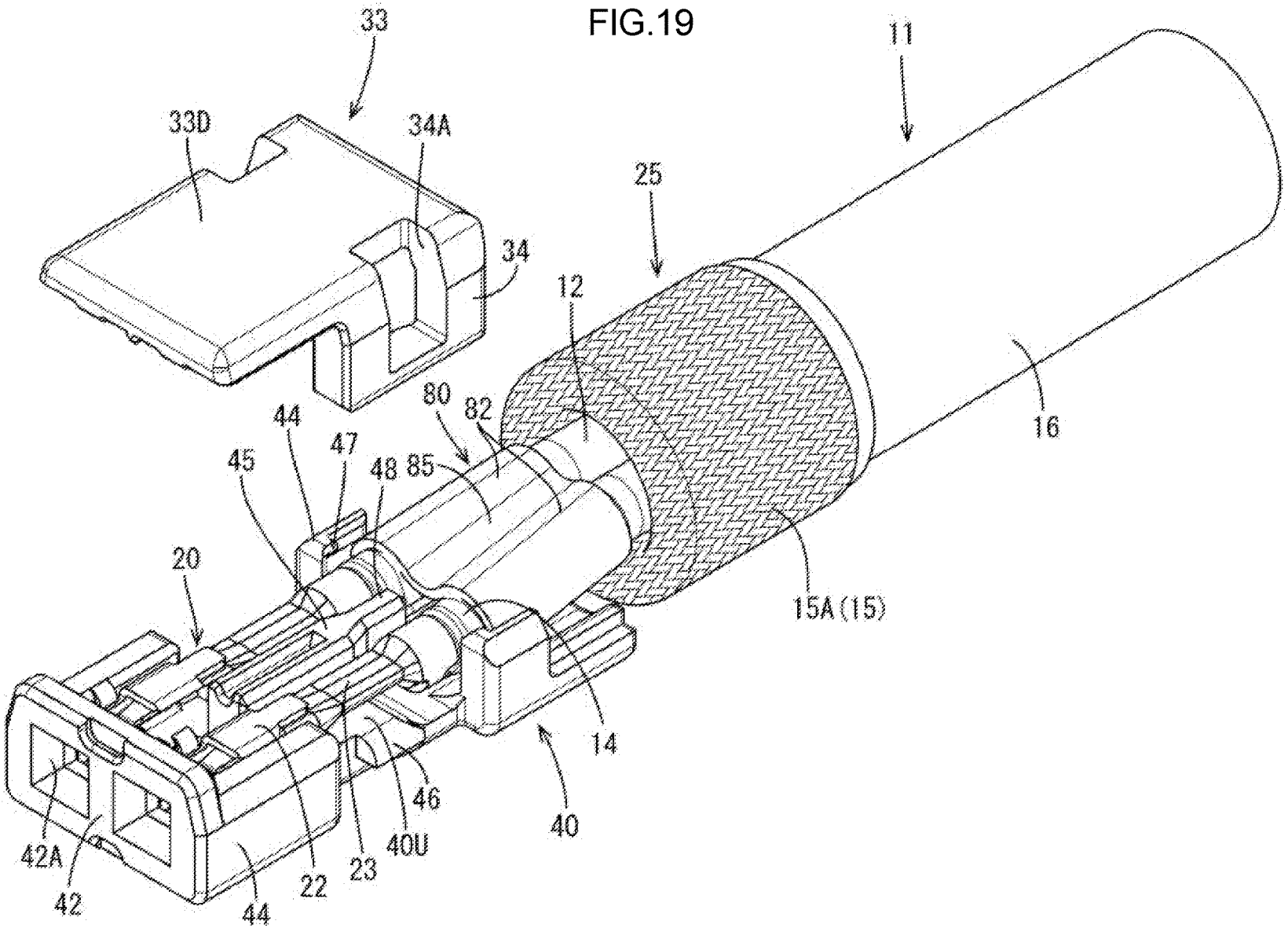
FIG. 19 is a perspective view illustrating the upper member that is disposed upside down before the lower member being fitted thereto.

As illustrated in FIGS. 19 and 20, the terminal housing member 30 includes a lower member 33 that is arranged in a lower section and an upper member 40 that is arranged in an upper section. The lower member 33 and the upper member 40 are fitted to each other in the upper-lower direction.

Figure 4:
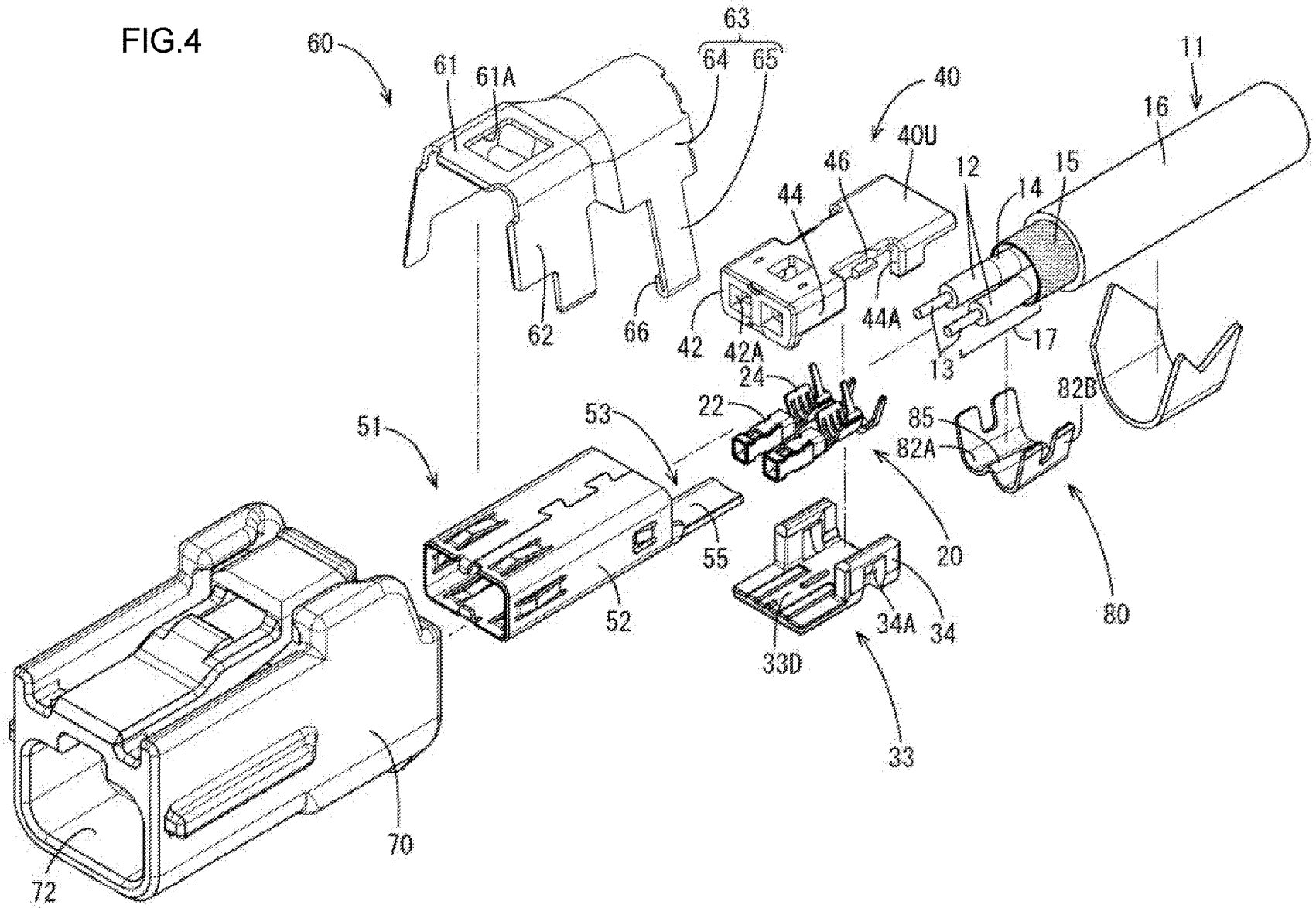
FIG. 4 is an exploded perspective view of the connector.

As illustrated in FIGS. 4 and 4, the lower member 33 includes a bottom wall 33D and two stopper pieces 34. The bottom wall 33D is configured as a lower wall 30D of the terminal housing member 30. The lower member 33 includes the two stopper pieces 34 at two side edges of the bottom wall 33D, respectively. The bottom wall 33D is a quadrangular plate that is elongated in the front-rear direction. The two inner conductive members 20 are arranged on the bottom wall 33D in the right-left direction.

The stopper pieces 34 extend upward from rear edge portions of the bottom wall 22D and each of the stopper pieces 34 includes a quadrangular stopper hole 34A that extends through the stopper piece 34 in the right-left direction.

Figure 8:
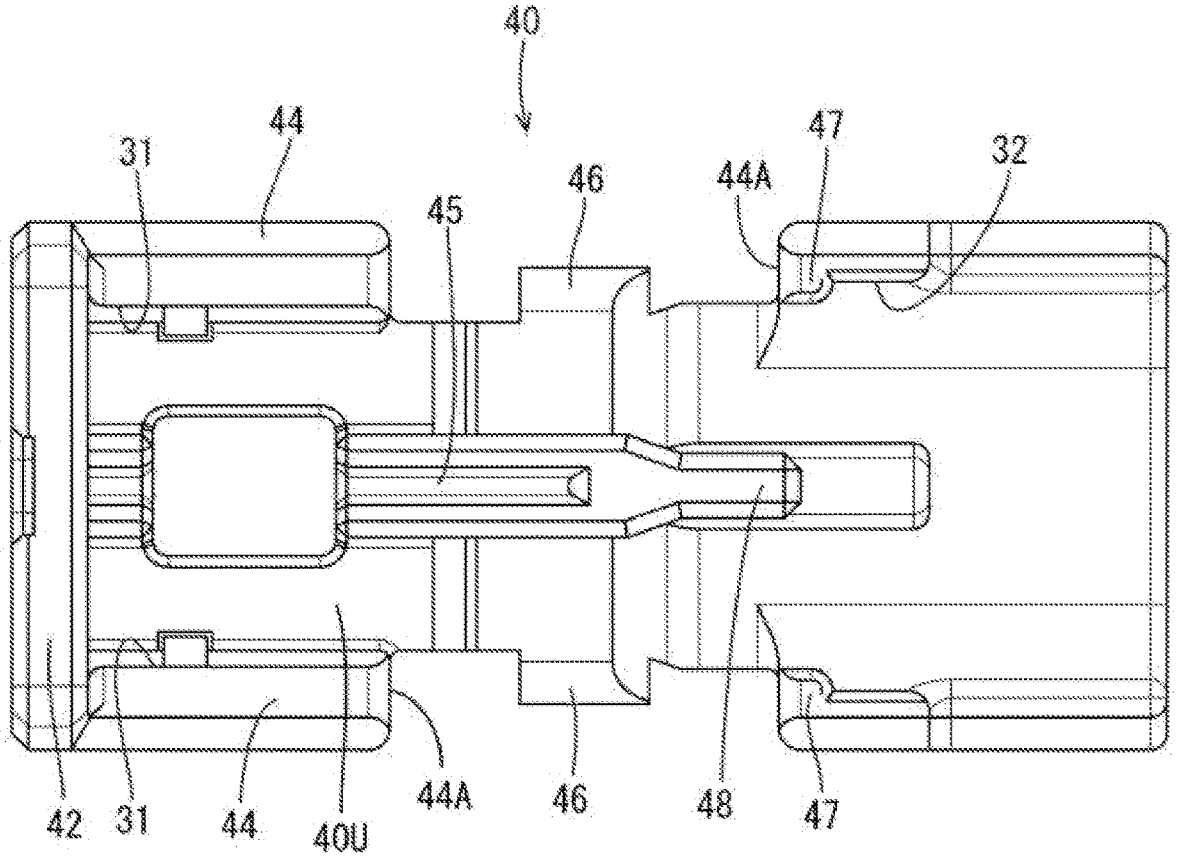
FIG. 8 is a bottom view of an upper member.
Figure 16:
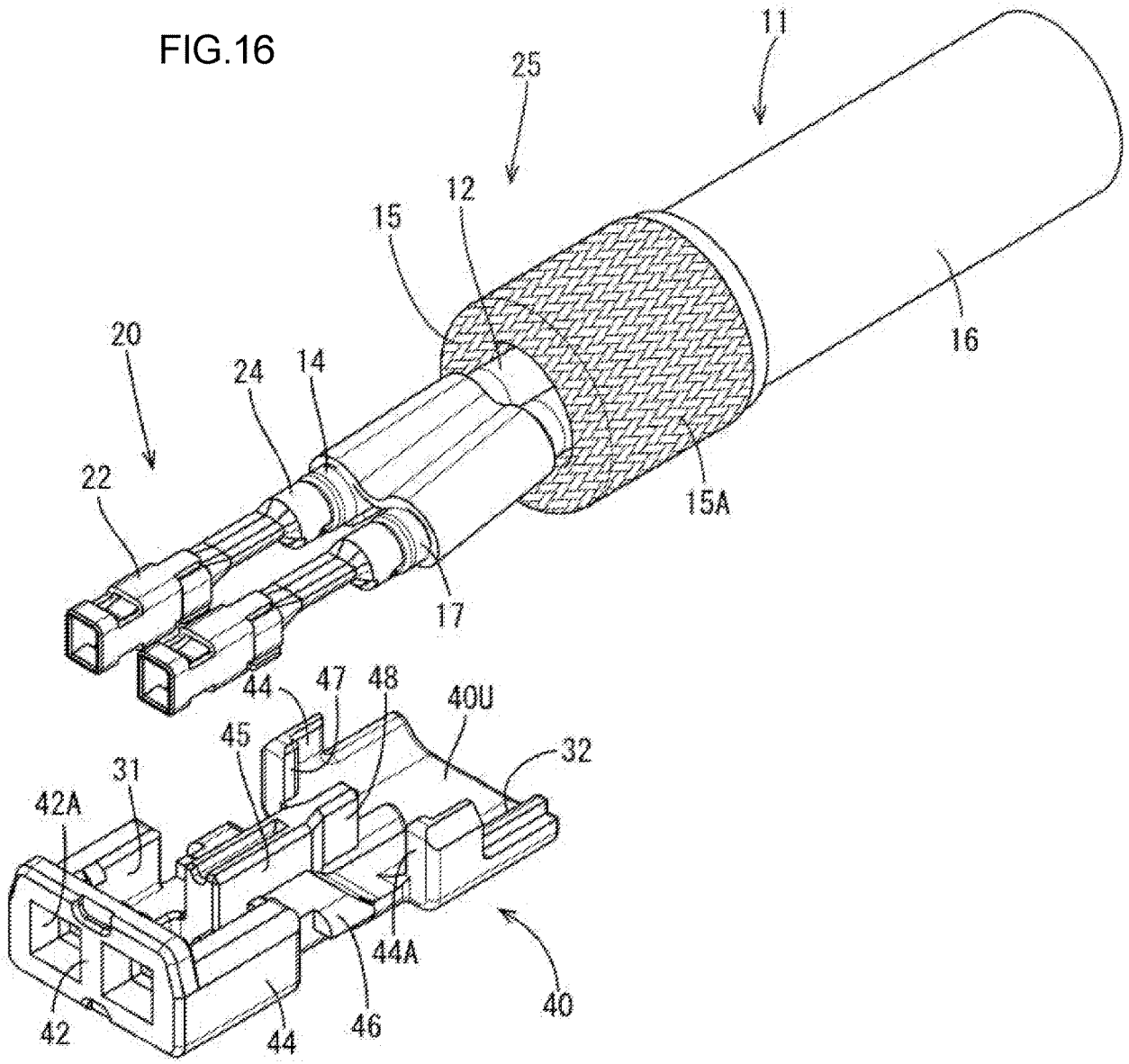
FIG. 16 is a perspective view illustrating an upper member that is disposed upside down before the electric wire with a terminal being mounted therein.

As illustrated in FIGS. 4, 8, and 16, the upper member 40 includes a ceiling wall 40U, a front wall 42 at a front edge of the ceiling wall 40U, and side walls 44 at two side edges of the ceiling wall 40U in the right-left direction. The ceiling wall 40U is configured as an upper wall 30U of the terminal housing member 30.

The ceiling wall 40U is a quadrangular plate elongated in the front-rear direction. The ceiling wall 40U includes a separation wall 45 at a middle section thereof with respect to the right-left direction. The separation wall 45 extends downward from the ceiling wall 40U. The separation wall 45 is arranged close to and opposite the bottom wall 33D of the lower member 33 in the upper-lower direction when the upper member 40 and the lower member 33 are fitted together. Thus, the two inner conductive members 20 are disposed separately by the separation wall 45 in the terminal housing member 30.

The front wall 42 is a plate extending downward from the front edge of the ceiling wall 40U. The front wall 42 includes insertion holes 42A through which the male terminals are to be inserted, respectively.

The side walls 44 extend downward from the ceiling wall 40U and are continuous from the respective two side edges of the front wall 42 with respect to the right-left direction.

Each of the side walls 44 includes a fitting recess 44A at a middle section thereof in the front-rear direction. The stopper pieces 34 of the lower member 33 are fitted to the respective fitting recesses 44A when the upper member 40 and the lower member 33 are fitted together. The fitting recess 44A has an opening edge in the side wall 44 extending from the lower edge thereof to the ceiling wall 40U in the upper-lower direction. The fitting recess 44A includes a fitting projection 46 at the side edge of the ceiling wall 40U. The fitting projection 46 projects outward from the side edge of the ceiling wall 40U.

As illustrated in FIG. 22, the fitting projections 46 are inserted into the respective stopper holes 34A of the stopper pieces 34 when the upper member 40 and the lower member 33 are fitted together and the stopper pieces 34 of the lower member 33 are fitted in the respective fitting recesses 44A. Thus, the upper member 40 and the lower member 33 are held in the fitted state.

As illustrated in FIGS. 3 and 4, the outer conductive member 50 includes a first outer conductive member 51 and a second outer conductive member 60. The first outer conductive member 51 covers an outer periphery of the terminal housing member 30. The second outer conductive member 60 is fitted to the first outer conductive member 51 so as to cover an outer periphery of the folded portion 15A of the shielded electric wire 11.

The first outer conductive member 51 is formed by pressing an electrically conductive metal plate and includes a tubular portion 52 and a shield connection portion 53 at a rear end of the tubular portion 52. The terminal housing member 30 is arranged in the tubular portion 52.

The tubular portion 52 has a square tubular shape having a quadrangular shape in an elevation view. The terminal housing member 30 is inserted from the rear side of the tubular portion 52 and arranged in the tubular portion 52.

As illustrated in FIG. 3, the shield connection portion 53 includes a connection portion 54 and a plate piece 55. The connection portion 54 extends obliquely toward a rear-lower side from a lower rear end of the tubular portion 52. The plate piece 55 extends straight rearward from a rear end of the connection portion 54.

The plate piece 55 is a quadrangular plate and is disposed along the lower outer peripheral surface of the folded portion 15A of the shielded electric wire 11 when the terminal housing member 30 is arranged in the tubular portion 52.

The second outer conductive member 60 is formed by pressing an electrically conductive metal plate. As illustrated in FIGS. 3 and 4, the second outer conductive member 60 includes a ceiling plate 61, a pair of fixing barrels 62, and a pair of connection barrels 63. The ceiling plate 61 extends along the tubular portion 52 and the folded portion 15A of the shielded electric wire 11. The fixing barrels 62 extend from a front portion of the ceiling plate 61. The connection barrels 63 extend from a rear portion of the ceiling plate 61.

The ceiling plate 61 has a plate area that covers the rear portion of the tubular portion 52 and the folded portion 15A from an upper side. The ceiling plate 61 includes a lance hole 61A in a front portion thereof and the lance hole 61A extends vertically through the ceiling plate 61.

The two fixing barrels 62 extend from right and left side edges of the front portion of the ceiling plate 61, respectively. The fixing barrels 62 are crimped onto and wrapped around the rear portion of the tubular portion 52 from the right and left sides.

The two connection barrels 63 are continuously provided on a rear side of the fixing barrels 62 and extend from right and left side edges of the rear portion of the ceiling plate 61, respectively. The connection barrels 63 are crimped onto and wrapped around the folded portion 15A from the right and left sides.

One of the connection barrels 63 includes a side plate 64 and a fixing piece 65. The side plate 64 extends along one of right and left side portion of the folded portion 15A. The fixing piece 65 extends upward from an upper edge of the side plate 64. Another one of the connection barrels 63 includes a side plate 64 extending along another one of the right and left side portion of the folded portion 15A and two fixing pieces 65 extending upward from an upper edge of the side plate 64.

The fixing pieces 65 are crimped onto and wrapped around the folded portion 15A and the plate piece 55 that is disposed on the upper surface of the folded portion 15A. Each of the fixing pieces 65 includes a hook portion 66 at a distal end thereof and the distal end is folded back inward to be configured as the hook portion 66.

When the fixing pieces 65 are crimped, one of the right and left side edges of the plate piece 55 is hooked by the hook portion 66 such that the fixing pieces 65 are fixed not to be released from the shielding portion 15. Accordingly, as illustrated in FIG. 3, the outer conductive member 50 including the first outer conductive member 51 and the second outer conductive member 60 is electrically connected to and fixed to the shielding portion 15 of the shielded electric wire 11.

The housing 70 is made of synthetic resin and includes an outer conductive member housing section 72 in which the outer conductive member 50 connected to the shielded electric wire 11 is arranged.

The outer conductive member housing section 72 has a square tubular shape that extends therethrough in the front-rear direction. The outer conductive member housing section 72 includes a lance 73 therein and the lance 73 is to be fitted in the lance hole 61A and stopped by an edge of the lance hole 61A of the outer conductive member 50. When the outer conductive member 50 is arranged in a correct arrangement position of the outer conductive member housing section 72, the lance 73 is fitted in the lance hole 61A and is stopped by the edge of the lance hole 61A and the outer conductive member 50 is held within the housing 70.

The rear portions of the two covered wires 12 extend rearward from the respective cavities 31 of the terminal housing member 30. As illustrated in FIGS. 12 to 20, the rear portions of the two covered wires 12 are uncovered portions 17 that are not covered with the sheath 16 of the shielded electric wire 11 and an impedance adjustment member 80 is attached to the uncovered portions 17.

The impedance adjustment member 80 is formed by pressing a metal plate having an electric conductive property. The impedance adjustment member 80 includes adjustment body portions 82 and a connection portion 85. The adjustment body portions 82 are attached to outer peripheries of the uncovered portions 17 of the covered wires 12. The connection portion 85 connects the adjustment body portions 82. The two adjustment body portions 82 that are to be attached to the respective two uncovered portions 17 of the two covered wires 12 are connected to each other by the connection portion 85 and configured as the impedance adjustment member 80 of the present embodiment.

Each of the adjustment body portions 82 has a substantially circular tubular shape that extends along the outer peripheral surface of the uncovered portion 17 to cover about three fourth of the outer peripheral surface of the uncovered portion 17 with respect to the circumferential direction. A side opening 83 is provided between the opposed adjustment body portions 82 and the side opening 83 is open in a radial direction. Each of the adjustment body portions 82 has a slit 84 at a middle portion of an opening edge of the side opening 83 with respect to the front-rear direction. The slit 84 extends in the circumferential direction.

The adjustment body portions 82 are attached to middle portions of the respective uncovered portions 17 with respect to the front-rear direction. The length dimension of the adjustment body portion 82 with respect to the front-rear direction is slightly smaller than the length dimension of the uncovered portion 17 with respect to the front-rear direction.

Therefore, a front portion and a rear portion of the uncovered portion 17 slightly project from and are not covered with the adjustment body portion 82. About one fourth of the uncovered portion 17 in the circumferential direction is exposed from the side opening 83 opening in the radial direction of the adjustment body portion 82 and is not covered with the adjustment body portions 82.

The connection portion 85 connects the two adjustment body portions 82 with respect to the right-left direction such that the opening edges of the side opening 83 of the respective adjustment body portions 82 are opposed to each other in the right-left direction. The connection portion 85 is curved to project upward.

Figure 13:
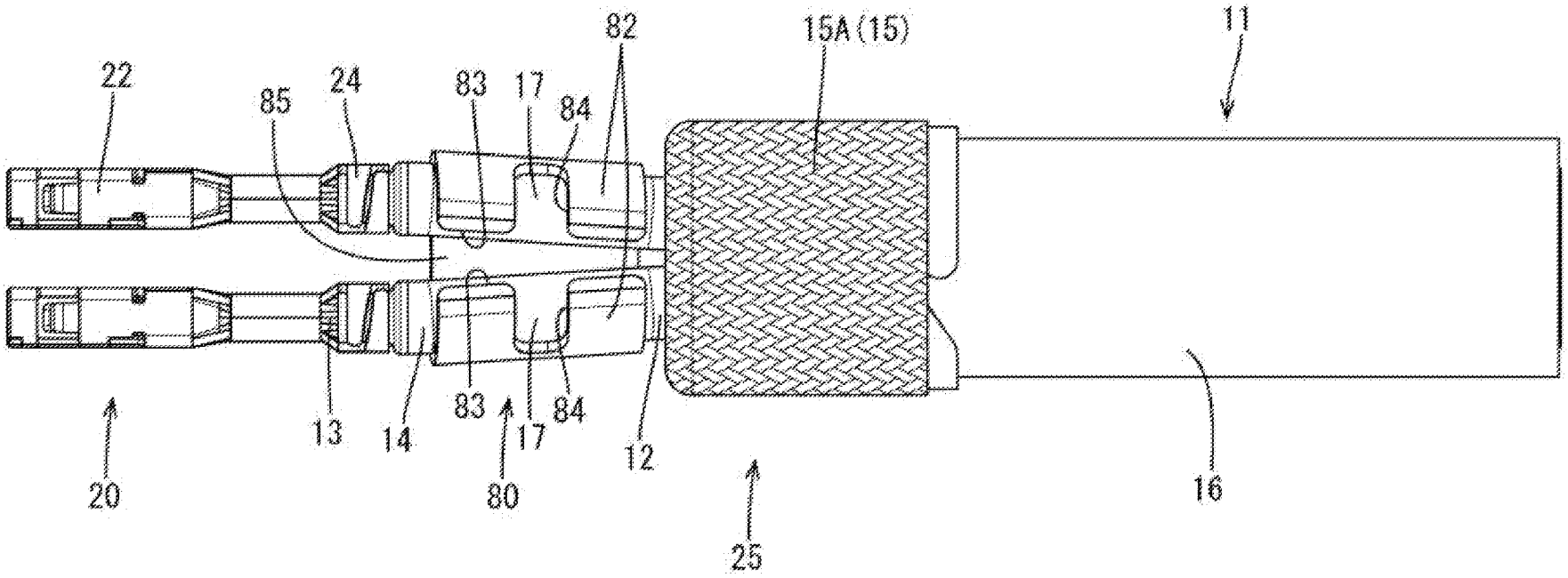
FIG. 13 is a plan view of the electric wire with a terminal.
Figure 14:
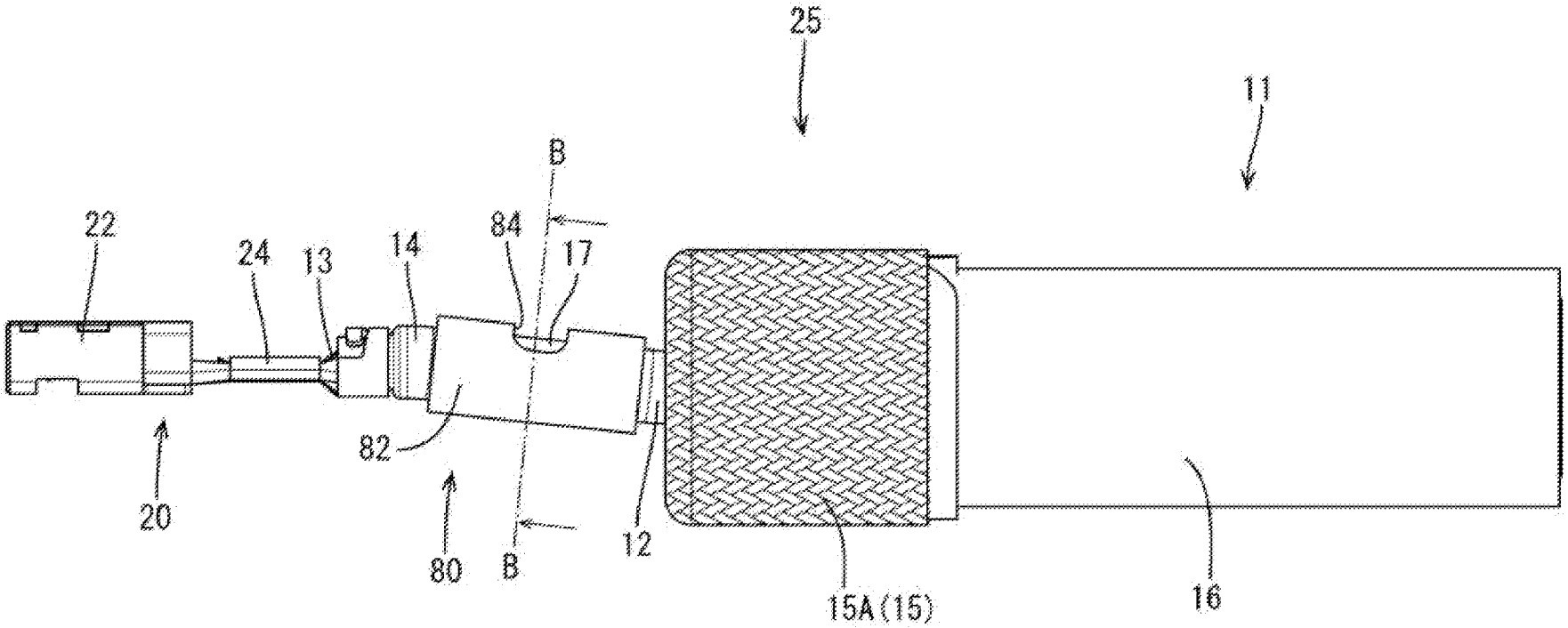
FIG. 14 is a side view of the electric wire with a terminal.
Figure 15:
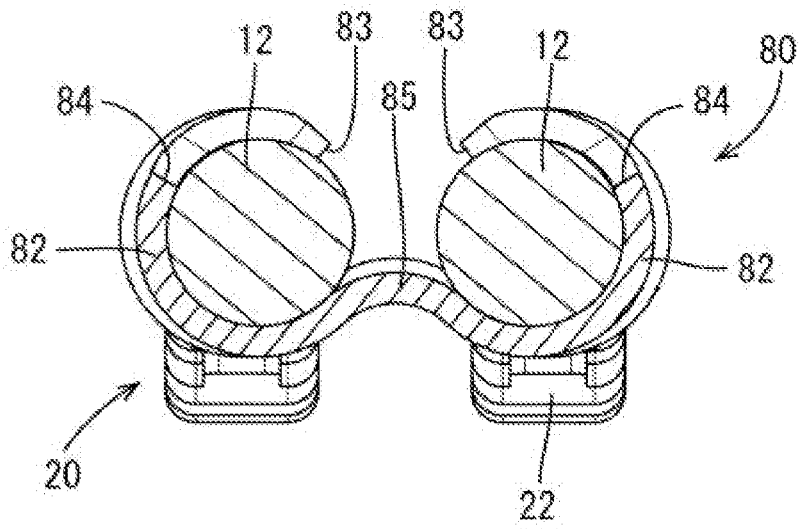
FIG. 15 is a cross-sectional view taken along B-B line in FIG. 14.
Figure 17:
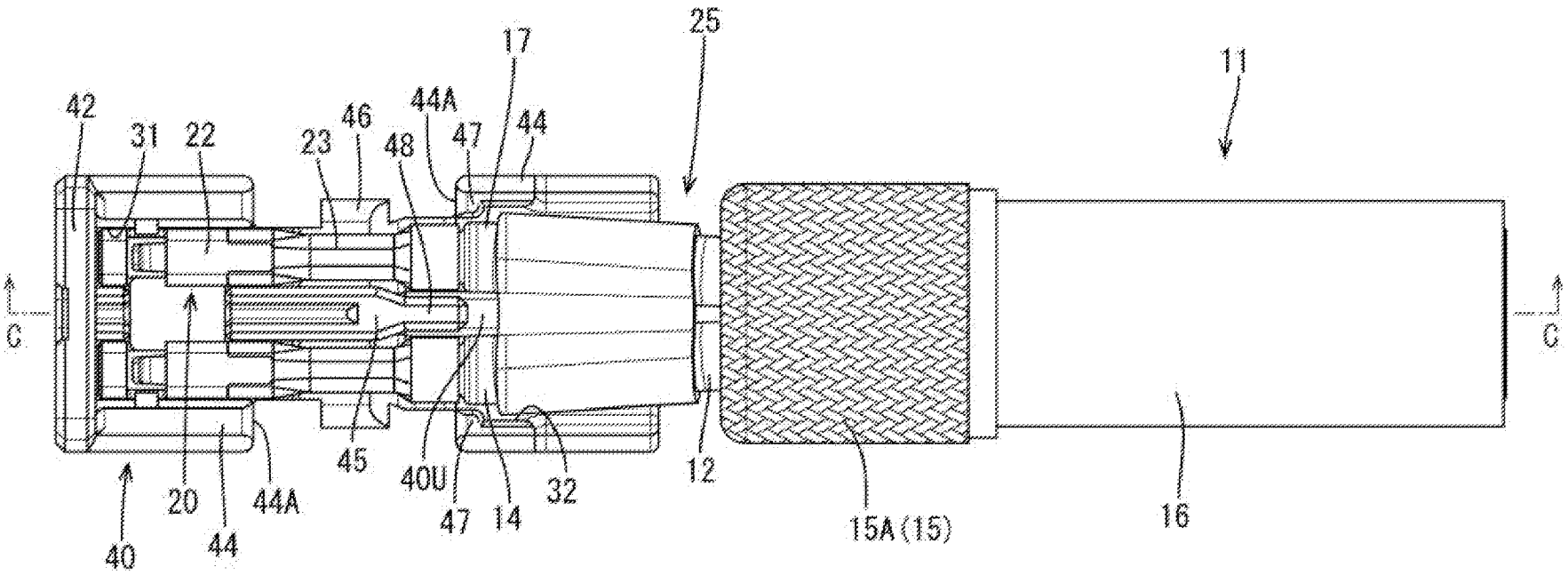
FIG. 17 is a plan view illustrating that the electric wire with a terminal is mounted in the upper member that is disposed upside down.

As illustrated in FIG. 13, the connection portion 85 is wider in the front portion than the rear portion thereof with respect to the right-left direction. As illustrated in FIGS. 16 and 17, the connection portion 85 is formed such that a distance between the adjustment body portions 82 that are continuous from the front end portion of the connection portion 85 is substantially equal to a distance between the inner conductive members 20 arranged in the terminal housing member 30.

In other words, the connection portion 85 connects the two adjustment body portions 82 such that a distance between the two covered wires 12 to which the respective adjustment body portions 82 are attached is substantially equal to the distance between the inner conductive members 20 arranged in the terminal housing member 30. The configuration that the distances are substantially equal includes a configuration that the distance between the covered wires 12 is same as the distance between the inner conductive members 20 and also a configuration that the distance between the covered wires 12 is not just same as the distance between the inner conductive members 20.

As illustrated in FIG. 17, the large housing portion 32 of the terminal housing member 30 can receive the uncovered portions 17 of the two covered wires 12 and the impedance adjustment member 80 therein. The large housing portion 32 that receives the impedance adjustment member 80 is provided in an area of the terminal housing member 30 and the width of the front end of the area for the large housing portion 32 is greater than a width of an area for the two cavities 31.

Each of the right and left side walls 30A of the terminal housing member 30 includes a body position detection portion 47 (one example of a position error detection portion) at a portion thereof between the area for the cavities 31 and the area for the large housing portion 32. The body position detection portion 47 projects toward an area in which the covered wires 12 are arranged. The body position detection portions 47 are disposed in front of the adjustment body portions 82 when the impedance adjustment member 80 that is attached to the uncovered portions 17 is arranged in the large housing portion 32.

The separation wall 45 that separates the two inner conductive members 20 from each other in the terminal housing member 30 includes a center position detection portion 48 (one example of the position error detection portion) at a rear end portion thereof. The center position detection portion 48 is disposed in front of the connection portion 85 when the impedance adjustment member 80 attached to the uncovered portions 17 is arranged in the large housing portion 32.

Figure 18:
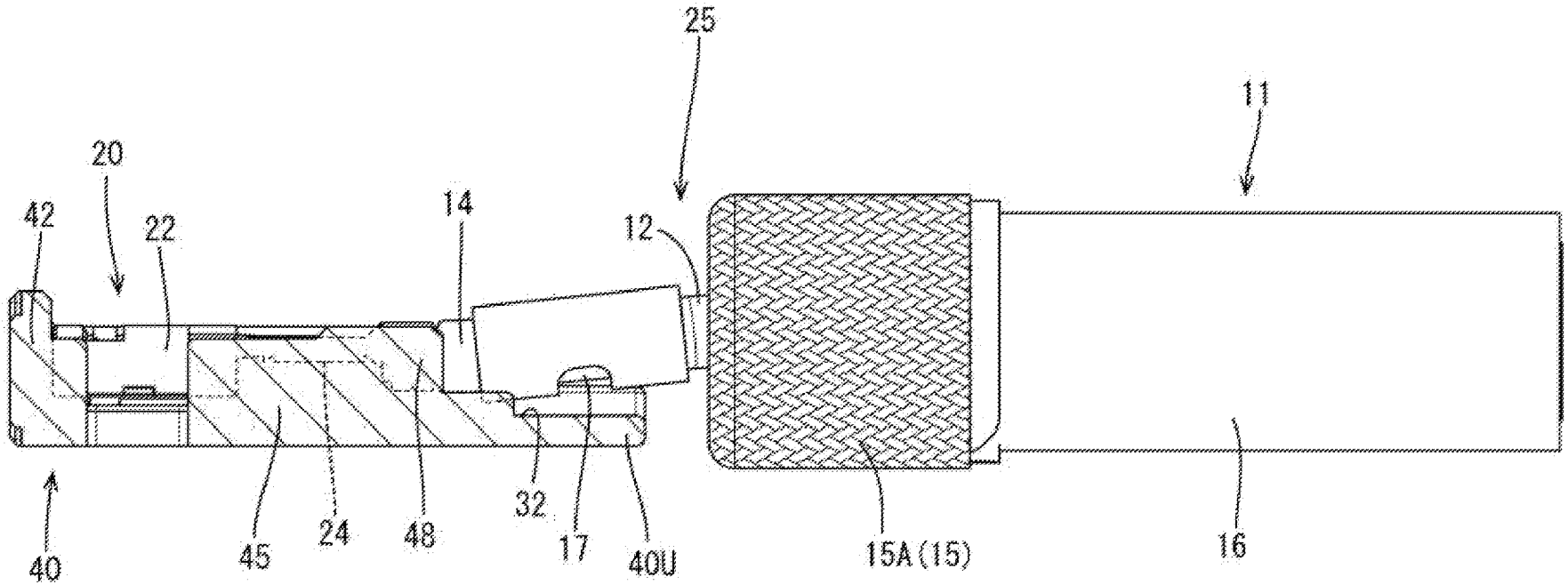
FIG. 18 is a cross-sectional view taken along C-C line in FIG. 17.
Figure 23:
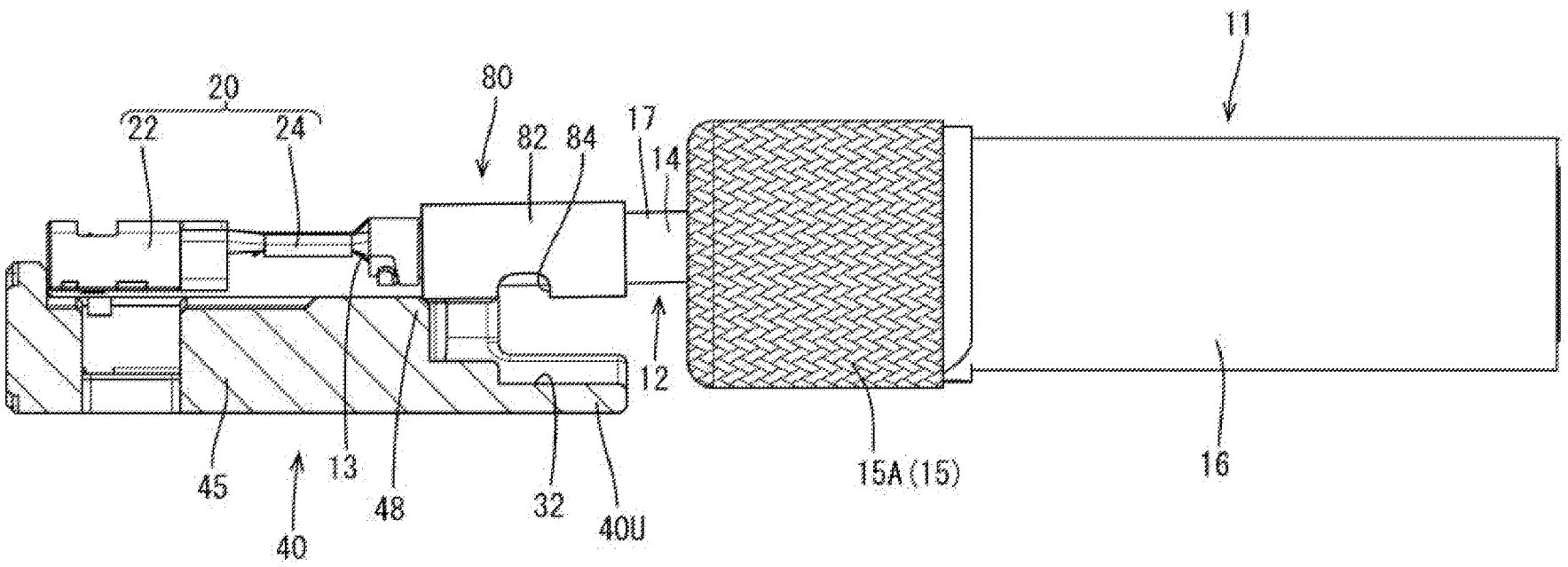
FIG. 23 is a cross-sectional view corresponding to FIG. 18 and illustrating that the impedance adjustment member mounted in an incorrect position is contacted with a center position error detection portion of the terminal housing member.

As illustrated in FIGS. 17 to 19, when the impedance adjustment member 80 is attached to the uncovered portions 17 in a correct position, the body position detection portions 47 and the center position detection portion 48 allow the impedance adjustment member 80 to be arranged in the large housing portion 32. On the other hand, when the impedance adjustment member 80 is attached to the uncovered portions 17 in an incorrect position and is displaced frontward from the correct position, the adjustment body portions 82 are contacted with the body position detection portions 47 or the connection portion 85 is contacted with the center position detection portion 48 as illustrated in FIG. 23. Therefore, the impedance adjustment member 80 cannot be put in the terminal housing member 30.

The present embodiment has the configuration previously described. Next, one example of steps of assembling the connector 10 for communication will be described and operations and effects of the connector 10 will be further described.

Figure 9:
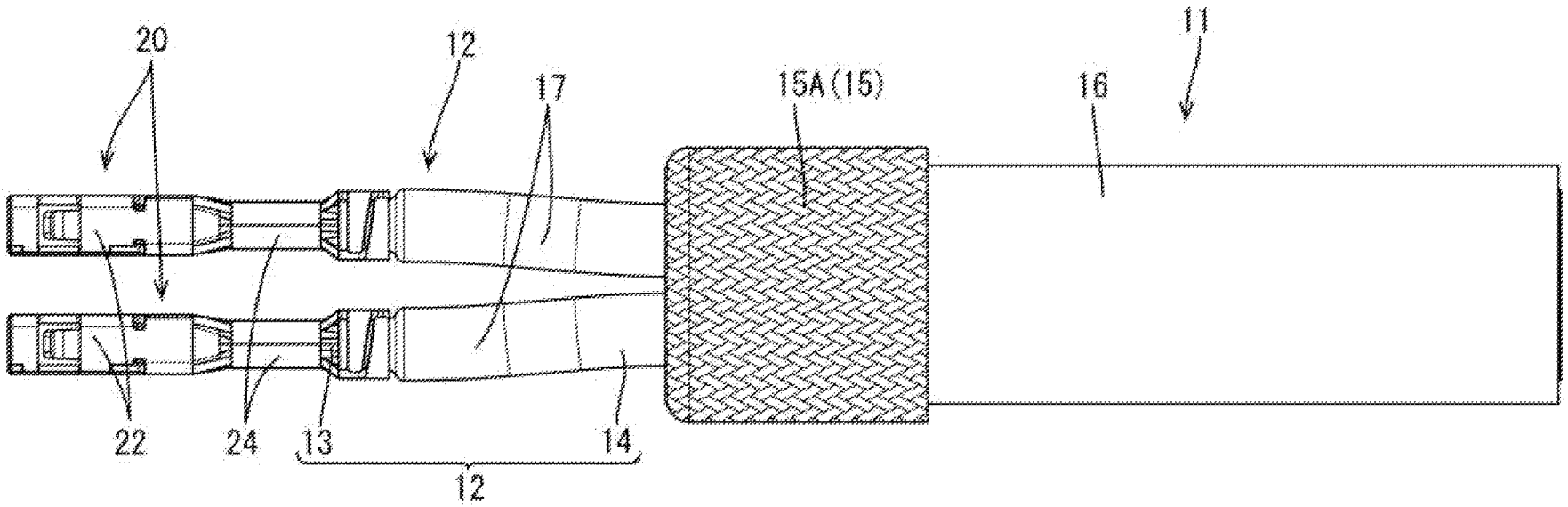
FIG. 9 is a plan view illustrating covered wires of a shielded portion connected to inner conductive members.
Figure 10:
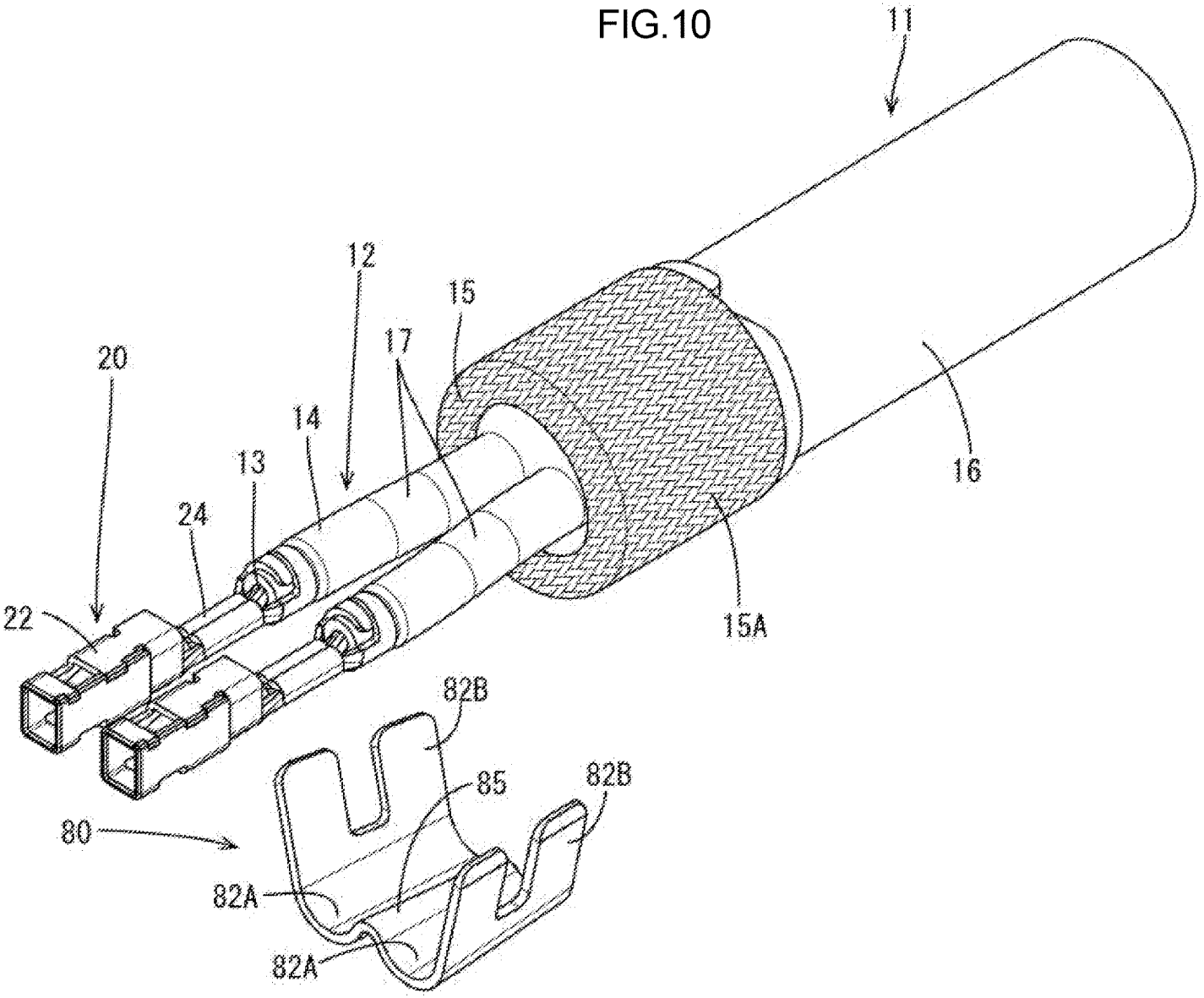
FIG. 10 is a perspective view illustrating uncovered portions before the impedance adjustment member being attached thereto.

First, a portion of the sheath 16 of the shielded electric wire 11 is stripped to uncover the end portions of the two covered wires 12 and the shielding portion 15. The uncovered shielding portion 15 is folded back onto the outer surface of the sheath 16 to form the folded portion 15A. The front end portions of the insulation covers 14 of the two covered wires 12 are stripped to uncover the core wires 13. As illustrated in FIG. 9, the wire connection portions 24 are crimped on the uncovered core wires 13 to connect the inner conductive members 20 to the covered wires 12.

Next, the impedance adjustment member 80 is attached to the uncovered portions 17 of the two covered wires 12 of the shielded electric wire 11.

Figure 5:
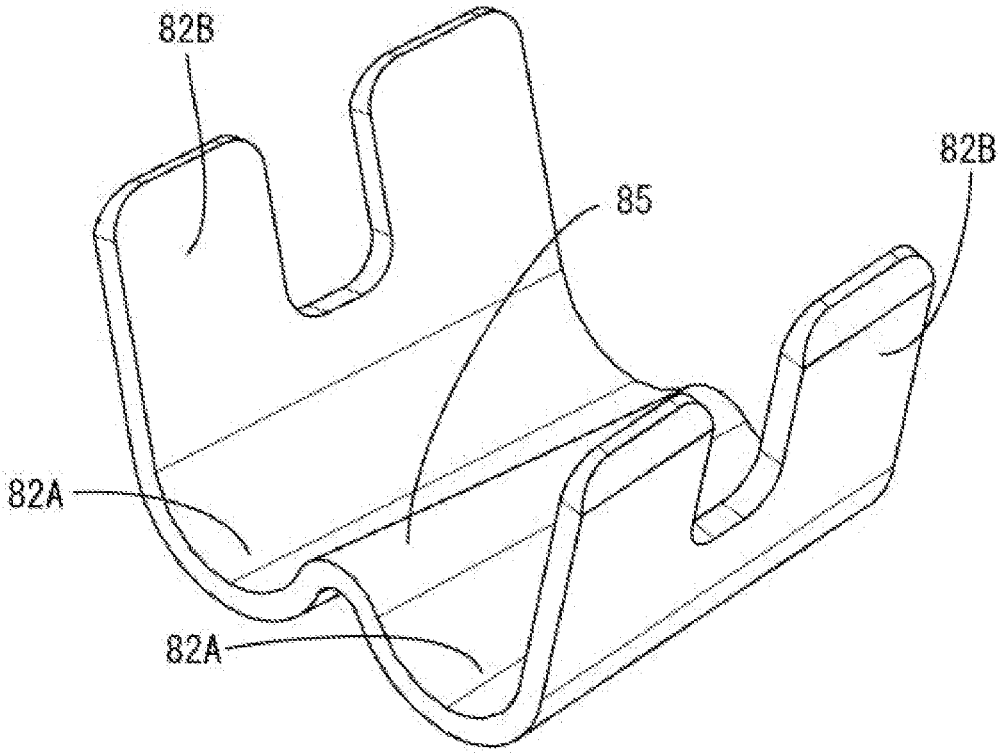
FIG. 5 is a perspective view illustrating an unfolded impedance adjustment member.
Figure 6:
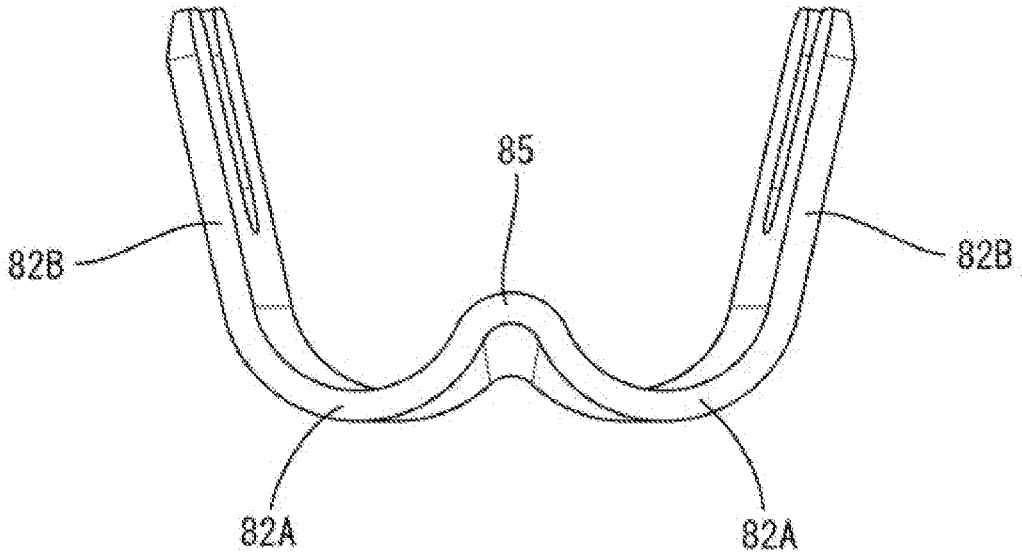
FIG. 6 is a front view illustrating the unfolded impedance adjustment member.
Figure 7:
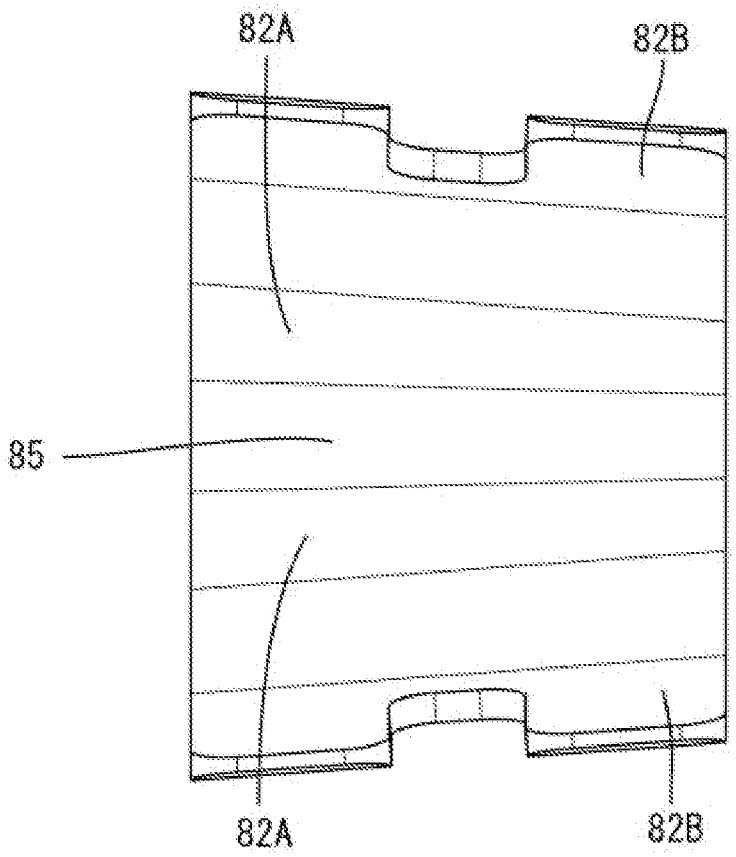
FIG. 7 is a plan view illustrating the unfolded impedance adjustment member.

As illustrated in FIGS. 5 to 7, the impedance adjustment member 80 that is in an unfolded state before being attached to the uncovered portions 17 includes the connection portion 85, two bottom portions 82A, and extending pieces 82B. The bottom portions 82A are continuous from side edges of the connection portion 85, respectively. The extending pieces 82B are continuous from side edges of the respective bottom portions 82A that are opposite from the connection portion 85. Each of the connection portion 85 and the bottom portions 82A is slightly wider at the front portion than the rear portion thereof.

Figure 11:
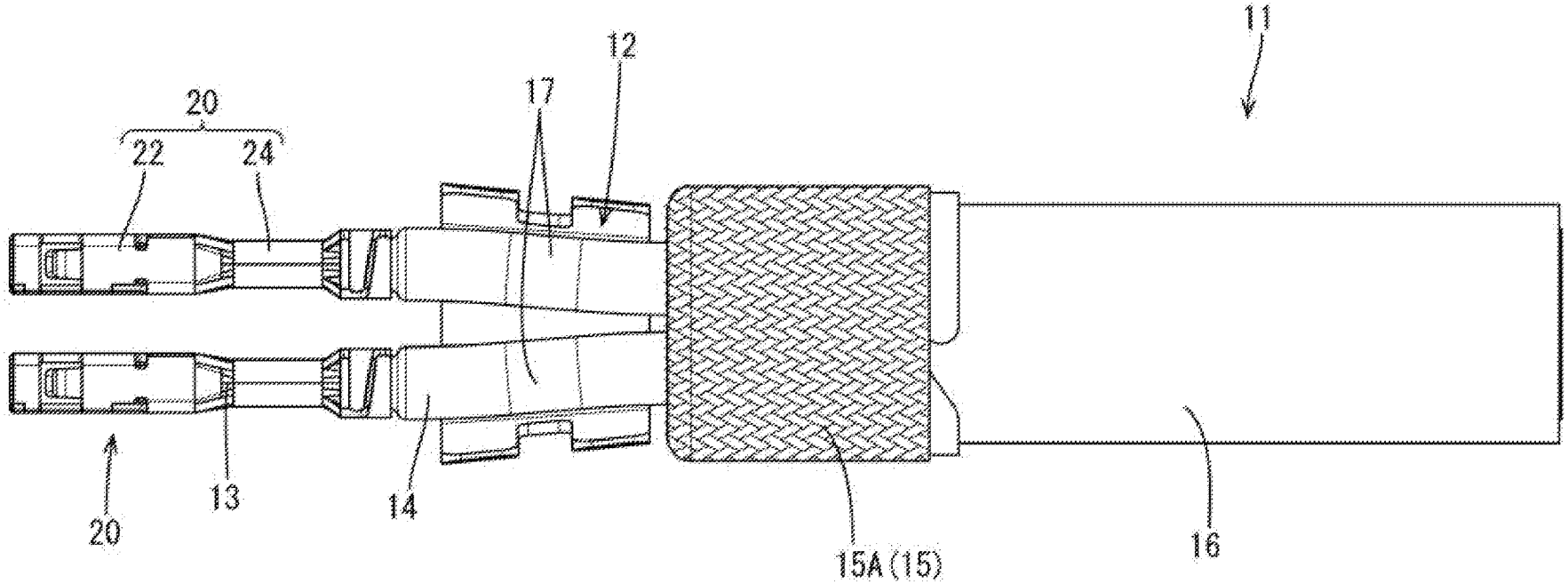
FIG. 11 is a plan view illustrating that the uncovered portions are disposed on a bottom portion of the impedance adjustment member.
Figure 12:
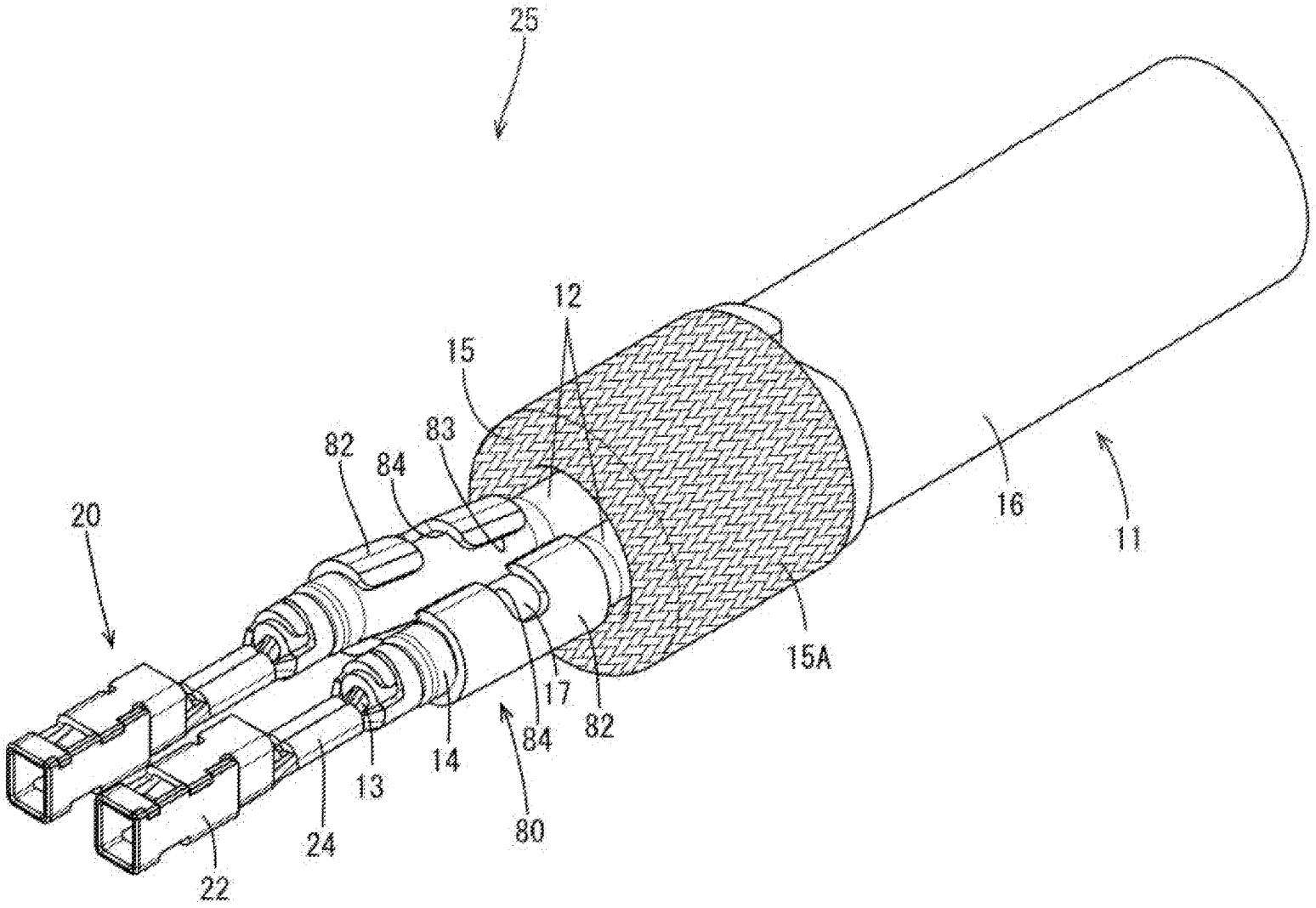
FIG. 12 is a perspective view of an electric wire with a terminal.

When the impedance adjustment member 80 is attached to the uncovered portions 17 of the two covered wires 12, as illustrated in FIG. 11, the uncovered portions 17 of the covered wires 12 are put on the two respective bottom portions 82A and the extending pieces 82B are crimped on and wrapped around the respective uncovered portions 17. Accordingly, as illustrated in FIGS. 12 to 16, the adjustment body portions 82 of the impedance adjustment member 80 are attached to the outer peripheries of the respective uncovered portions 17. Thus, an electric wire with a terminal 25 is completed.

When the impedance adjustment member 80 is attached to the uncovered portions 17 of the two covered wires 12, the distance between the two covered wires 12 to which the respective adjustment body portions 82 are attached is substantially equal to the distance between the inner conductive members 20 that are to be arranged in the terminal housing member 30.

As illustrated in FIG. 16, the two inner conductive members 20 of the completed electric wire with a terminal 25 are mounted on the ceiling wall 40U of the upper member 40 of the terminal housing member 30 that is disposed upside down.

When mounting the inner conductive members 20 in the respective correct mounting positions on the ceiling wall 40U of the upper member 40, the inner conductive members 20 need to be positioned with respect to the respective correct mounting positions on the ceiling wall 40U of the upper member 40. In the present embodiment, the distance between the two covered wires 12 is substantially equal to the distance between the inner conductive members 20 to be arranged in the terminal housing member 30. Therefore, the inner conductive members 20 need not be positioned with respect to the respective correct mounting positions on the ceiling wall 40U of the upper member 40 and the two inner conductive members 20 can be mounted in the respective correct mounting positions, as illustrated in FIGS. 17 and 18, only by placing the electric wire with a terminal 25 on the ceiling wall 40U of the upper member 40 from the upper side.

Figure 21:
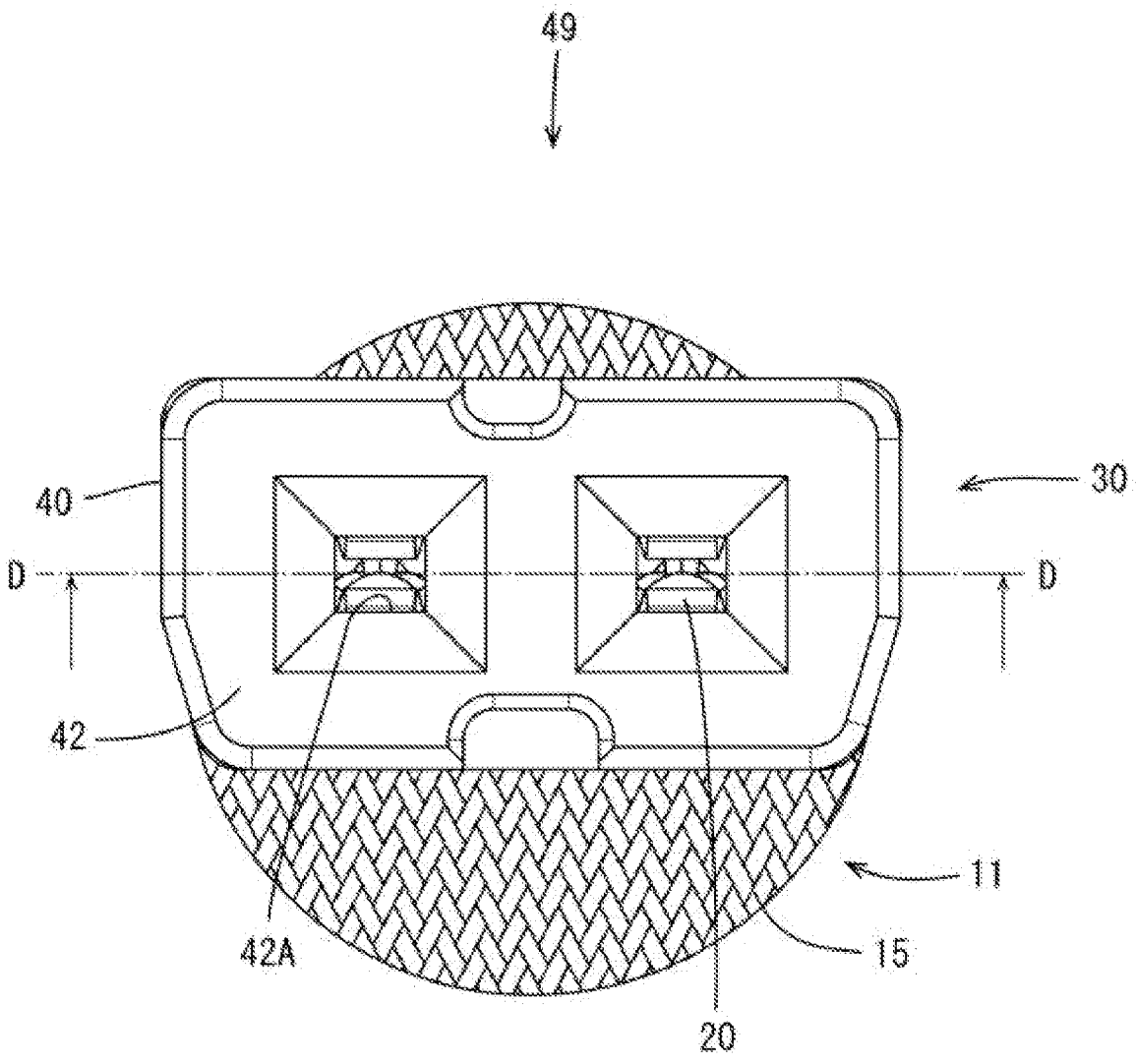
FIG. 21 is a front view of a terminal module.

The lower member 33 is mounted on the upper member 40 from the upper side after the electric wire with a terminal 25 is mounted on the ceiling wall 40U of the upper member 40. As illustrated in FIGS. 20 to 22, a terminal module 49 is completed by attaching the terminal housing member 30 to the electric wire with a terminal 25.

Next, the terminal housing member 30 of the terminal module 49 is inserted in the tubular portion 52 of the first outer conductive member 51 of the outer conductive member 50 from the rear side to attach the first outer conductive member 51 to the outer periphery of the terminal housing member 30 of the terminal module 49. Then, the second outer conductive member 60 is attached to the first outer conductive member 51.

The second outer conductive member 60 is attached to the first outer conductive member 51 as follows. The first outer conductive member 51 is placed on the ceiling plate 61 of the second outer conductive member 60 such that the plate piece 55 of the first outer conductive member 51 is on an upper side. The fixing barrels 62 are crimped on and wrapped around the tubular portion 52 and the fixing pieces 65 of the respective connection barrels 63 are crimped on and wrapped around the plate piece 55 and the shielding portion 15. Then, the hook portion 66 of the fixing piece 65 is hooked on the side edge of the plate piece 55 such that the fixing piece 65 is not released from the plate piece 55 and the shielding portion 15.

Next, the terminal module 49 to which the outer conductive member 50 is attached is inserted in the outer conductive member housing section 72 of the housing 70 from the rear side. When the outer conductive member 50 reaches the correct housing position, as illustrated in FIG. 3, the lance 73 is fitted in the lance hole 61A of the outer conductive member 50 such that the outer conductive member 50 is held in the housing 70 not to be released from the housing 70. Thus, the connector 10 for communication is completed.

Next, operations and effects of the connector 10 for communication will be described.

To connect the inner conductive members 20 to the covered wires 12 of the shielded electric wire 11, the sheath 16 needs to be stripped at the end of the shielded electric wire 11 and the shielding portion 15 needs to be folded back. In such a configuration, signal reflection may occur in the uncovered portions 17 of the covered wires 12 that are not covered with the shielding portion 15 at the end of the shielded electric wire 11 and this may lower the communication quality.

As a result of the present inventors' earnest study for solving the above problems, they figured out the configuration of the present embodiment. The connector 10 for communication of the present embodiment includes the shielded electric wire 11 and the inner conductive members 20 (a terminal). The shielded electric wire 11 includes at least one covered wire 12, the shielding portion 15 having an electric conductive property, and the sheath 16. The covered wire 12 includes the core wire 13 through which communication signals are transmitted and the insulation cover 14 having an insulation property and covering the core wire 13. The shielding portion 15 covers an outer periphery of the covered wire 12. The sheath 16 covers an outer periphery of the shielding portion 15. The inner conductive member 20 is connected to the covered wire 12. The covered wire 12 includes an end portion near the inner conductive member 20 (a front side) that projects from and is not covered with the sheath 16 and the shielding portion 15 and configured as the uncovered portion 17. As illustrated in FIGS. 12 to 15, the uncovered portion 17 is covered with the impedance adjustment member 80 having an electric conductive property.

According to the present embodiment, the uncovered portion 17 of the covered wire 12 is covered with the impedance adjustment member 80 having an electric conductive property. The uncovered portion of the covered wire 12 projecting and exposed from the shielding portion 15 is covered with the electrically conductive member and the electrically conductive member extends to cover the uncovered portion of the covered wire 12 projecting from the shielding portion 15 just before the end portion to be connected to the inner conductive member 20. According to such a configuration, the impedance is less likely to change between the covered wire 12 covered with the shielding portion 15 and the uncovered portion 17. This suppresses lowering of the communication quality of the covered wire 12.

The shielded electric wire 11 includes the covered wires 12 and the impedance adjustment member 80 includes the adjustment body portions 82 having a tubular shape. The adjustment body portions 82 are fitted to the respective uncovered portions 17 and disposed along the outer periphery surfaces of the uncovered portions 17.

Since the uncovered portions 17 of the covered wires 12 projecting from the shielding portion 15 are covered with the adjustment body portions 82, respectively and independently from each other, each of the adjustment body portions 82 can suppress change in the impedance of the corresponding one of the uncovered portions 17 of the covered wires 12 independently. Therefore, the impedance is further less likely to change at the uncovered portion 17 compared to a configuration that the uncovered portions 17 of the covered wires 12 are collectively covered with an impedance adjustment member.

The adjustment body portion 82 has the slit 84 extending in the circumferential direction and the area of the adjustment body portion 82 that covers the uncovered portion 17 can be changed easily by changing the size of the slit 84. Therefore, the impedance in the uncovered portion 17 can be easily adjusted.

Namely, the accuracy of adjusting the impedance in the uncovered portion 17 can be improved. This further suppresses occurrence of the reflection of signals between the covered wire 12 covered with the shielding portion 15 and the uncovered portion 17 and lowering of the communication quality is further suppressed.

The impedance adjustment member 80 further includes the connection portion 85 connecting the adjustment body portions 82. With such a configuration, the number of components included in the impedance adjustment member 80 is reduced compared to a configuration including adjustment body portions each of which is prepared separately for each of the uncovered portions.

As illustrated in FIGS. 20 to 22, the connector 10 for communication further includes the terminal housing member 30 in which the inner conductive members 20 are arranged. The connection portion 85 connects the adjustment body portions 82 such that the distance between the covered wires 12 is substantially equal to the distance between the inner conductive members 20 to be arranged in the terminal housing member 30.

Namely, the connecting portion 85 of the impedance adjustment member 80 can adjust the distance between the covered wires 12 to match the distance between the inner conductive members 20 in the terminal housing member 30. This improves the operability of mounting the inner conductive members 20 in the terminal housing member 30 compared to a configuration in which each of the inner conductive members 20 is positioned and mounted in each of the cavities 31.

The terminal housing member 30 includes the large housing portion 32 (an adjustment member housing portion) in which the impedance adjustment member 80 is arranged. The terminal housing member 30 includes the body position detection portions 47 and the center position detection portion 48 (the position error detection portion) between the cavities 31 for receiving the inner conductive members 20 and the large housing portion 32. The impedance adjustment member 80 is contacted with the body position detection portions 47 and the center position detection portion 48 if the impedance adjustment member 80 is not mounted in the correct position with respect to the uncovered portions 17.

For example, if the impedance adjustment member 80 is mounted in an incorrect position, which is different from the correct position, with respect to the uncovered portions 17 of the covered wires 12, the impedance may not be adjusted effectively in the uncovered portions 17 and the communication quality may be lowered. If the impedance adjustment member 80 is mounted closer to the inner conductive members 20, the inner conductive members 20 may be contacted with the impedance adjustment member 80 and a short circuit may occur between the inner conductive members 20.

In the terminal housing member 30 of the present embodiment, if the impedance adjustment member 80 is mounted in an incorrect position and closer to the front side with respect to the uncovered portions 17, the following problems may be caused. As illustrated in FIG. 23, the adjustment body portions 82 of the impedance adjustment member 80 may be contacted with the body position detection portion 47 or the connection portion 85 may be contacted with the center position detection portion 48 when the impedance adjustment member 80 is mounted in the large housing portion 32. Therefore, the impedance adjustment member 80 that is in the incorrect position cannot be mounted in the large housing portion 32.

Namely, according to the present embodiment, the communication quality is less likely to be lowered due to the incorrect positioning of the impedance adjustment member 80 with respect to the uncovered portions 17 and a short circuit may not occur between the inner conductive members 20. Further, the impedance adjustment member 80 may not be moved frontward with respect to the uncovered portions 17 due to vibration.

The center position detection portion 48 is defined as the separation wall 45 that separates the inner conductive members 20 from each other in the terminal housing member 30. Namely, the incorrect positioning of the impedance adjustment member 80 can be detected by the separation wall 45 that defines each of the cavities 31 in the terminal housing member 30. Therefore, an incorrect position detection portion need not be additionally and separately provided in the terminal housing member 30 and a shape of the terminal housing member 30 is less likely to become complicated.

Other Embodiments

The technology disclosed herein is not limited to the embodiment described above and illustrated in the drawings. For example, the following embodiments will be included in the technical scope of the technology.

(1) In the above embodiment, the two adjustment body portions 82 are connected to each other by the connection portion 85. However, the configuration is not limited to the above one and two adjustment body portions may be included as separate components.

(2) In the above embodiment, the adjustment body portion 82 of the impedance adjustment member 80 includes the slit 84. However, the configuration is not limited to the above one and an adjustment body portion 182 of an impedance adjustment member 180 may not include a slit.

(3) In the above embodiment, the impedance adjustment member 80 is not connected to the shielding portion 15. However, the configuration is not limited to the above one and the impedance adjustment member may be electrically connected to the shielding portion.

Figure 24:
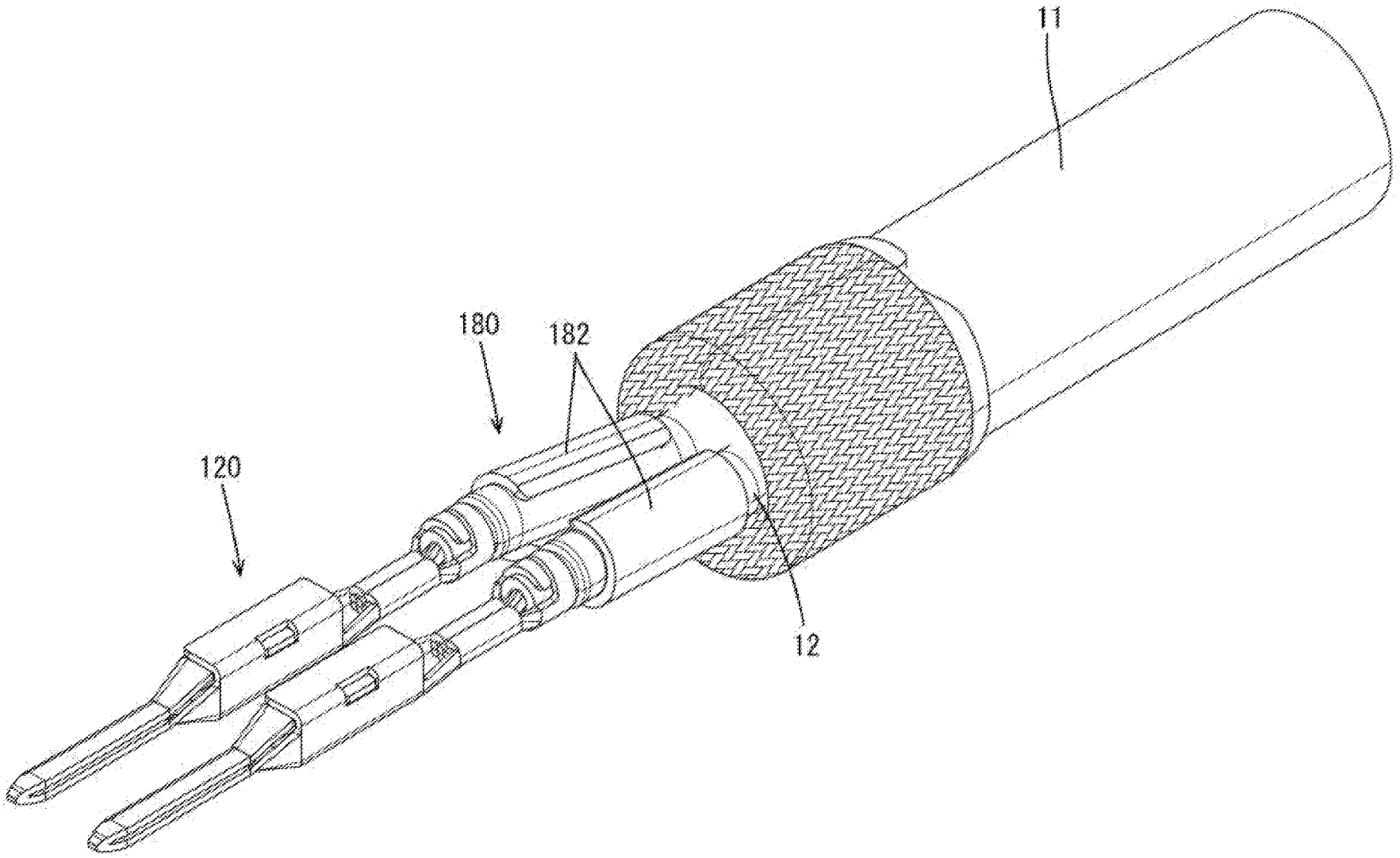
FIG. 24 is a perspective view of an electric wire with a terminal according to another embodiment.

(4) In the above embodiment, the inner conductive members 20 connected to the respective two covered wires 12 of the shielded electric wire 11 are configured as female terminals. However, the configuration is not limited to the above one and as illustrated in FIG. 24, inner conductive members 124 connected to the respective two covered wires 12 of the shielded electric wire 11 may be configured as male terminals.

EXPLANATION OF SYMBOLS

10: Connector
11: Shielded electric wire
12: Covered wire
13: Core wire
14: Insulation cover
15: Shielding portion
16: Sheath
17: Uncovered portion
20: Inner conductive member (one example of a terminal)
30: Terminal housing member
32: Large housing portion (one example of an adjustment member housing portion)
45: Separation wall
47: Body position detection portion (one example of a position error detection portion)
48: Center position detection portion (one example of the position error detection portion)
49: Terminal module
50: Outer conductive member
70: Housing
80: Impedance adjustment member
82: Adjustment body portion
84: Slit
85: Connection portion

The invention claimed is:

1. An electric wire comprising:

a shielded electric wire comprising:

a covered wire including a core wire through which a signal for communication is transmitted and an insulation cover that has insulation property and covers the core wire;

a shielding portion having electric conductive property and covering an outer periphery of the covered wire; and a sheath covering an outer periphery of the shielding portion; and a terminal connected to the covered wire, wherein the covered wire has an end portion close to the terminal and the end portion is an uncovered portion that is not covered with the sheath and the shielding portion, the uncovered portion is covered with an impedance adjustment member that has electric conductive property, the covered wire of the shielded electric wire includes covered wires each of which has the uncovered portion, and the impedance adjustment member includes adjustment body portions that have a tubular shape and mounted on and along an outer peripheral surface of the uncovered portion of each of the covered wires.

2. The electric wire according to claim 1, wherein the adjustment body portions include slits, respectively, that extend in a circumferential direction.

3. The electric wire according to claim 1, wherein the impedance adjustment member further includes a connection portion that connects the adjustment body portions.

4. A terminal module comprising:

the electric wire according to claim 3 including terminals; and a terminal housing member in which the terminals are arranged, wherein the connection portion connects the adjustment body portions such that a distance between the covered wires is substantially equal to a distance between the terminals in the terminal housing member.

5. The terminal module according to claim 4, wherein the terminal housing member includes an adjustment member housing portion in which the impedance adjustment member is arranged, and the terminal housing member includes a position error detection portion between a portion in which the terminals are arranged and the adjustment member housing portion and the position error detection portion is contacted with the impedance adjustment member when the impedance adjustment member is not mounted in a correct position with respect to the uncovered portion.

6. The terminal module according to claim 5, wherein the position error detection portion is a separation wall that separates the terminals from each other in the terminal housing member.

7. A connector comprising:

the terminal module according to claim 5;

an outer conductive member covering an outer periphery of the terminal module; and a housing in which the terminal module covered with the outer conductive member is arranged.

8. The electric wire according to claim 2, wherein the impedance adjustment member further includes a connection portion that connects the adjustment body portions.

9. A terminal module comprising:

the electric wire according to claim 8 including terminals; and a terminal housing member in which the terminals are arranged, wherein the connection portion connects the adjustment body portions such that a distance between the covered wires is substantially equal to a distance between the terminals in the terminal housing member.

10. The terminal module according to claim 9, wherein the terminal housing member includes an adjustment member housing portion in which the impedance adjustment member is arranged, and the terminal housing member includes a position error detection portion between a portion in which the terminals are arranged and the adjustment member housing portion and the position error detection portion is contacted with the impedance adjustment member when the impedance adjustment member is not mounted in a correct position with respect to the uncovered portion.

11. The terminal module according to claim 10, wherein the position error detection portion is a separation wall that separates the terminals from each other in the terminal housing member.

12. A connector comprising:

the terminal module according to claim 9;

an outer conductive member covering an outer periphery of the terminal module; and a housing in which the terminal module covered with the outer conductive member is arranged.

13. A connector comprising:

the terminal module according to claim 5;

an outer conductive member covering an outer periphery of the terminal module; and a housing in which the terminal module covered with the outer conductive member is arranged.

14. A connector comprising:

the terminal module according to claim 10;

an outer conductive member covering an outer periphery of the terminal module; and a housing in which the terminal module covered with the outer conductive member is arranged.

15. A connector comprising:

the terminal module according to claim 6;

an outer conductive member covering an outer periphery of the terminal module; and a housing in which the terminal module covered with the outer conductive member is arranged.

16. A connector comprising:

the terminal module according to claim 11;

an outer conductive member covering an outer periphery of the terminal module; and a housing in which the terminal module covered with the outer conductive member is arranged.

* * * * *